United States Patent [19]

Guerout et al.

[11] Patent Number: 4,793,038

[45] Date of Patent: Dec. 27, 1988

[54] APPARATUS FOR MAKING HARNESSES OF RIBBON CABLE

[75] Inventors: Jean B. Guerout, Conflans Saint Honorine; Andre Canu, Beauchamp; Jack Urbin, Triel; Alain Lavedan, Mezy sur Seine, all of France

[73] Assignee: AMP Incorporated, Harrisburg, Pa.

[21] Appl. No.: 38,266

[22] Filed: Apr. 14, 1987

[30] Foreign Application Priority Data

Apr. 14, 1986 [FR] France ..... 86 05283

[51] Int. Cl.[4] ..... H01R 43/00

[52] U.S. Cl. ..... 29/33 M; 29/564.6; 29/564.8; 29/749; 29/857

[58] Field of Search ..... 29/33 P, 33 M, 33 Q, 29/564, 564.6, 564.7, 566.1, 749, 755, 857, 861, 564.8

[56] References Cited

U.S. PATENT DOCUMENTS

| | | | |
|---|---|---|---|
| 3,369,434 | 2/1968 | Schwalm | 29/203 MW |
| 3,758,935 | 9/1973 | Long et al. | 29/203 MW |
| 4,137,624 | 2/1979 | Davis et al. | 29/566.1 |
| 4,267,757 | 5/1981 | Frantz | 83/464 |
| 4,460,804 | 7/1984 | Svejkovsky | 174/117 A |
| 4,525,927 | 7/1985 | Guerout et al. | 29/861 |
| 4,552,260 | 11/1985 | Teagno et al. | 29/33 P |
| 4,641,427 | 2/1987 | Shields | 29/749 |
| 4,647,323 | 3/1987 | Darstein et al. | 29/33 M |
| 4,715,099 | 12/1987 | Yoshida | 29/564.6 |

FOREIGN PATENT DOCUMENTS

| | | | |
|---|---|---|---|
| 21237 | 1/1981 | European Pat. Off. | 29/749 |
| 0024828 | 3/1981 | European Pat. Off. . | |
| 1508553 | 1/1968 | France . | |
| 2138962 | 1/1973 | France . | |

*Primary Examiner*—Gil Weidenfeld
*Assistant Examiner*—Daniel W. Howell
*Attorney, Agent, or Firm*—Robert W. J. Usher; William B. Noll

[57] ABSTRACT

A method and apparatus for making electrical harnesses of flat cable (30) terminated at respective opposite ends in electrical connectors (13) with individual conductors electrically connected to corresponding contacts of rows of contacts in conductor-receiving faces of the connectors (13). The flat cable (30) is fed longitudinally along a path extending towards a terminating station adjacent the feed path (12) along which the contact rows extend and a loop is formed in a leading end with the plane of the cable (30) and the loop axis extending perpendicularly to the contact rows and conductor-receiving faces. The leading and trailing ends of the cable loop are then rotated in opposite senses through 90° to extend parallel to the plane of the conductor-receiving faces of the connectors (13) with individual conductors aligned with respective contacts and terminated therein. The apparatus includes a cable end slitting mechanism (35), eye forming mechanism (32), loop forming mechanism (37) and transfer mechanism (39).

17 Claims, 36 Drawing Sheets

9
8

61'
62
65
68
69
84
64
82
83
112
30
81
70
121
74
78
71
77
75
76
9
61
8

APPARATUS FOR MAKING HARNESSES OF RIBBON CABLE

The invention relates to a method and apparatus for making harnesses in which ribbon (flat) cable is terminated at opposite ends by respective connectors with individual conductors of the cable being connected to respective contacts of rows of contacts in the connectors.

In one respect, the invention may be regarded as a method and apparatus for handling ribbon (flat) cable for use with connector transfer apparatus similar to that described in U.S. Pat. No. 4,552,260. In such apparatus, pairs of connectors are indexed along a feed path extending past operating units in which a loop extending transversely across the feed path is formed in a wire to be terminated and a leading and trailing end of the wire terminated in predetermined contacts of rows of contacts extending along the feed path of the respective connectors of each pair of connectors.

The invention is particularly concerned with the termination of the cable conductors in connectors having contacts with wire receiving slots of the type referred to hereinbelow.

In another respect, the invention may be regarded as a method and apparatus for making harnesses of ribbon (flat) cable in which the cable is terminated by a plurality of connectors at one end and a single connector at the other end, or in which the ribbon cable is longitudinally divided to form two.

In the interests of reasonable simplicity, economy of tooling, and speed of application, it is desirable to terminate the individual conductors of the flat cable, at least at one end, substantially simultaneously in the contacts of the connector as they lie, arranged in a row, extending along the feed path in the connector feed or transfer direction. Immediately prior to termination, the faces of the same sides of cable ends should extend in the same plane as the row of contacts, i.e. perpendicular to the direction of insertion, with the conductors extending transversely of the contact row and therefore the connector feed path for enabling them to be inserted into the contacts by simple action insertion rams.

However, problems arise in the handling of the ends of loops of flat cable both in view of its bulk and refractory quality and it is important therefore to minimize the need to reorient the cable ends in confined locations crowded with closely spaced tooling, particularly adjacent the connectors.

According to one aspect of the invention, the ribbon (or flat) cable is fed longitudinally towards the connector feed path and insertion tooling along a feed axis extending transversely of the feed path with the plane of the cable extending perpendicularly to the plane of the terminating faces containing the contact rows of the connectors, the leading end of the cable is returned to form a loop, the cable is fed to desired length with the loop axis extending perpendicularly of the contact row, and the leading and trailing ends of the loop are twisted or rotated about their longitudinal axes through 90° so that their planes extend parallel to the contact rows. Feeding the cable so that the plane of the cable ends is oriented perpendicularly of the contact rows enables correct final orientation of the cable for direct insertion to be obtained by relatively simple rotation of the cable through only 90°.

Desirably, the cable loop is fed to desired length to extend across the feed path. The cable loops terminated in connectors will then move along the side of the feed path remote from the tooling during indexing of the terminated connectors.

Preferably, the leading and trailing ends of the cable are rotated in opposite angular directions to present the same side of the cable to the respective connectors at each end of the cable. This ensures that any individual conductor is connected at both ends to contacts in identical positions in respective connectors.

In one specific mode of the invention, a slit is formed in one end of the cable to divide the one end into two branches.

According to another aspect ofo the invention, apparatus for making a harness in which a conductor is terminated at opposite ends by respective electrical connectors comprises connector transfer means to index a series of connector pairs along a feed path past a terminating station with contact rows of the connectors extending along the feed path; means to feed a conductor to the terminating station along a path extending transversely of the feed path; means to form loops of desired length in a leading end of the conductor extending across the feed path; and means to insert the leading and trailing ends of the conductor loop in repsective connectors of the pair on the feed path is characterised in that, for making harnesses of flat cable, the cable feed means feeds the flat cable to the feed path with its plane extending perpendicularly of the contact rows and to form the cable loop with its axis perpendicular to the contact rows so that respective ends of the cable loop extend perpendicularly of the feed path, and transfer means to transfer the cable ends from the loop-forming means and to twist the cable ends through 90° to extend in planes parallel to the contact rows with the individual conductors extending perpendicularly of the connector rows aligned with the respective contacts.

The apparatus is relatively simple as the extensive reorientation of the ends of the refractive cable loops is avoided in the crowded termination and loop-forming location.

Preferably, the tranfer means twists the cable ends in opposite angular directions.

The invention includes other operating units described hereinbelow in relation to the specific example and in the claims both in combination and individually.

More specifically, the invention includes aspects of the cable rotating unit; aspects of the eye forming unit; the cable end separating unit; and the cable transfer unit.

An example of the invention will now be described with reference to the accompanying drawings in which.

Figures 4A, 4B, 4C:
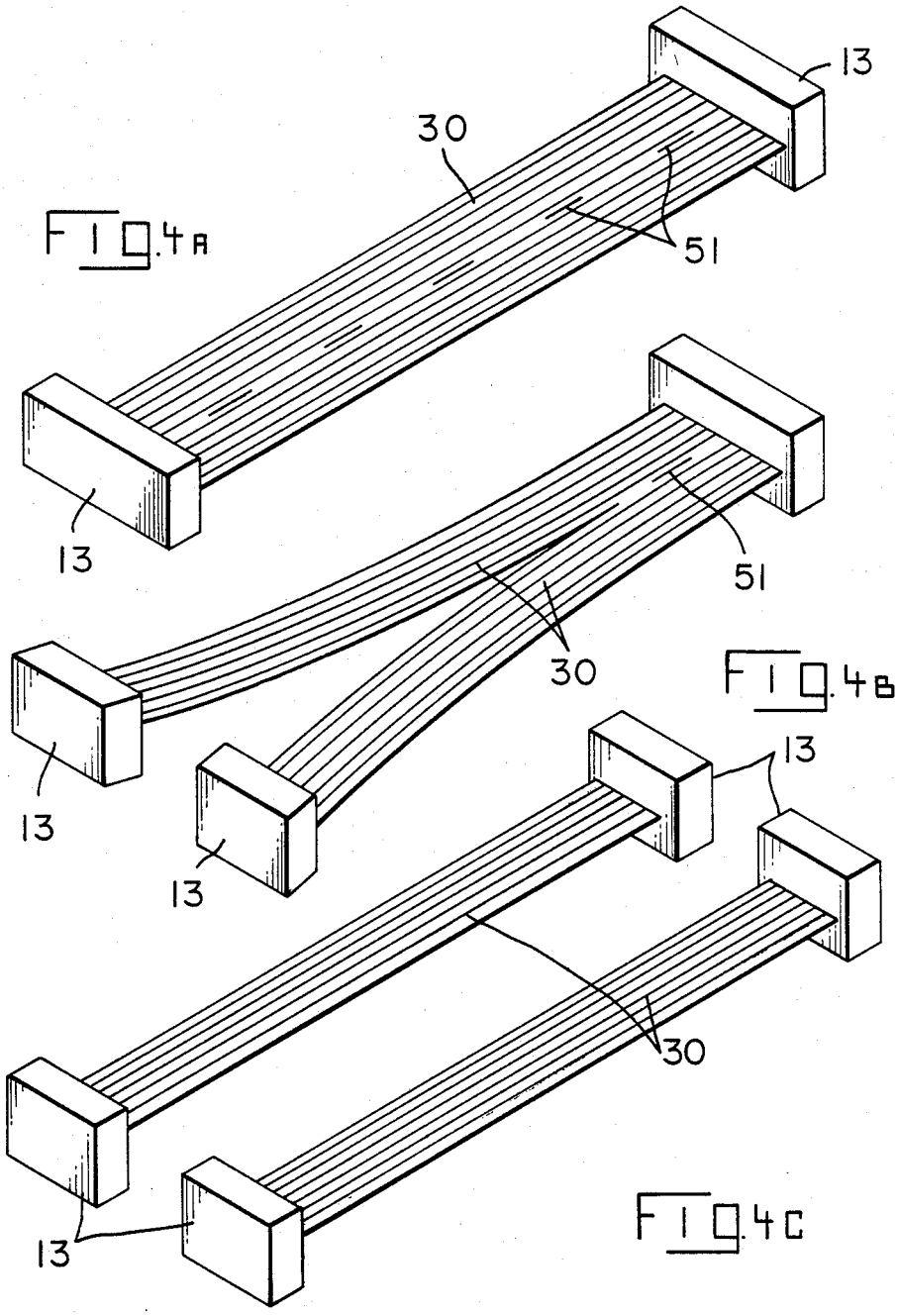
Figure 5:
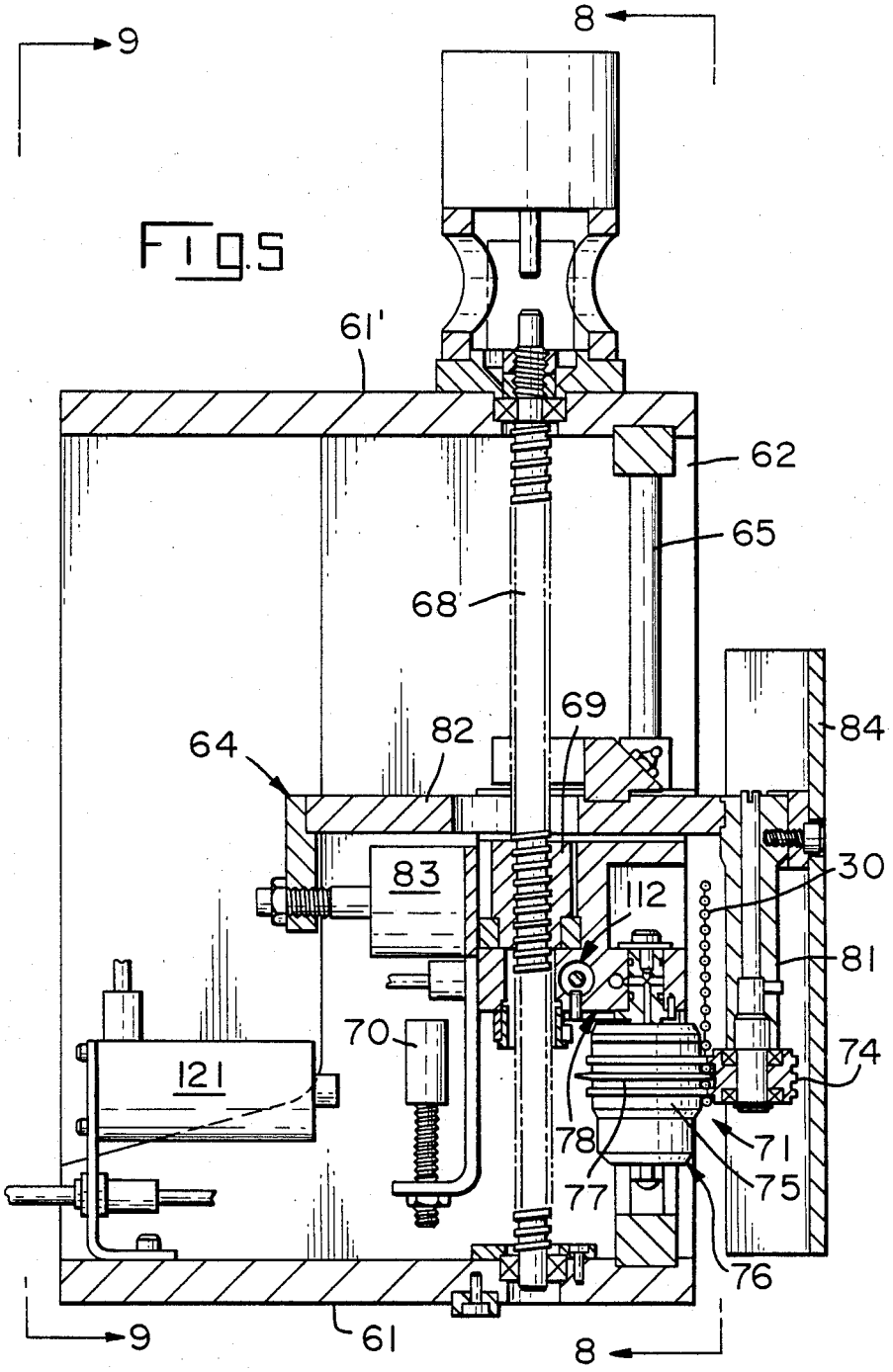
Figure 6:
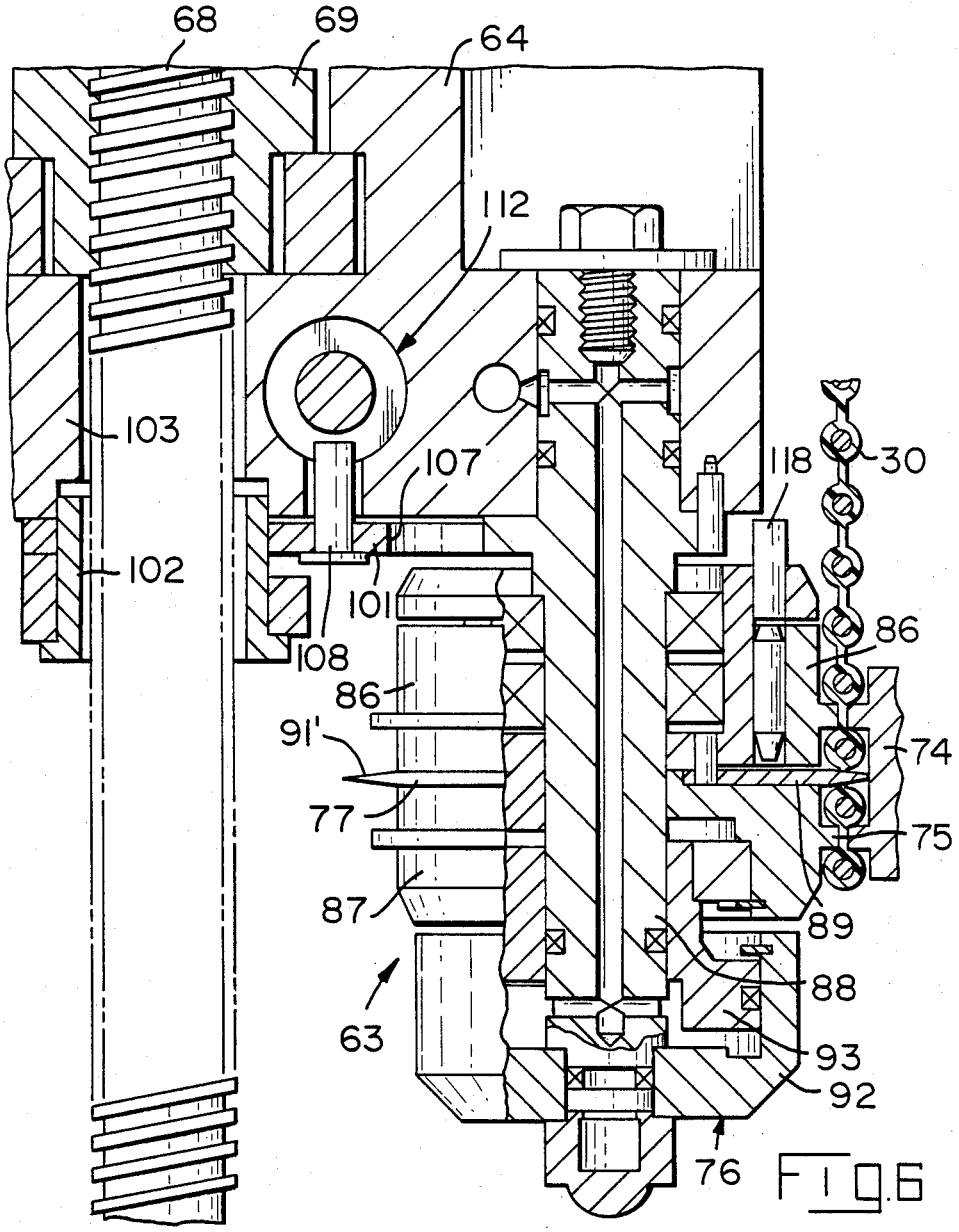
Figure 7:
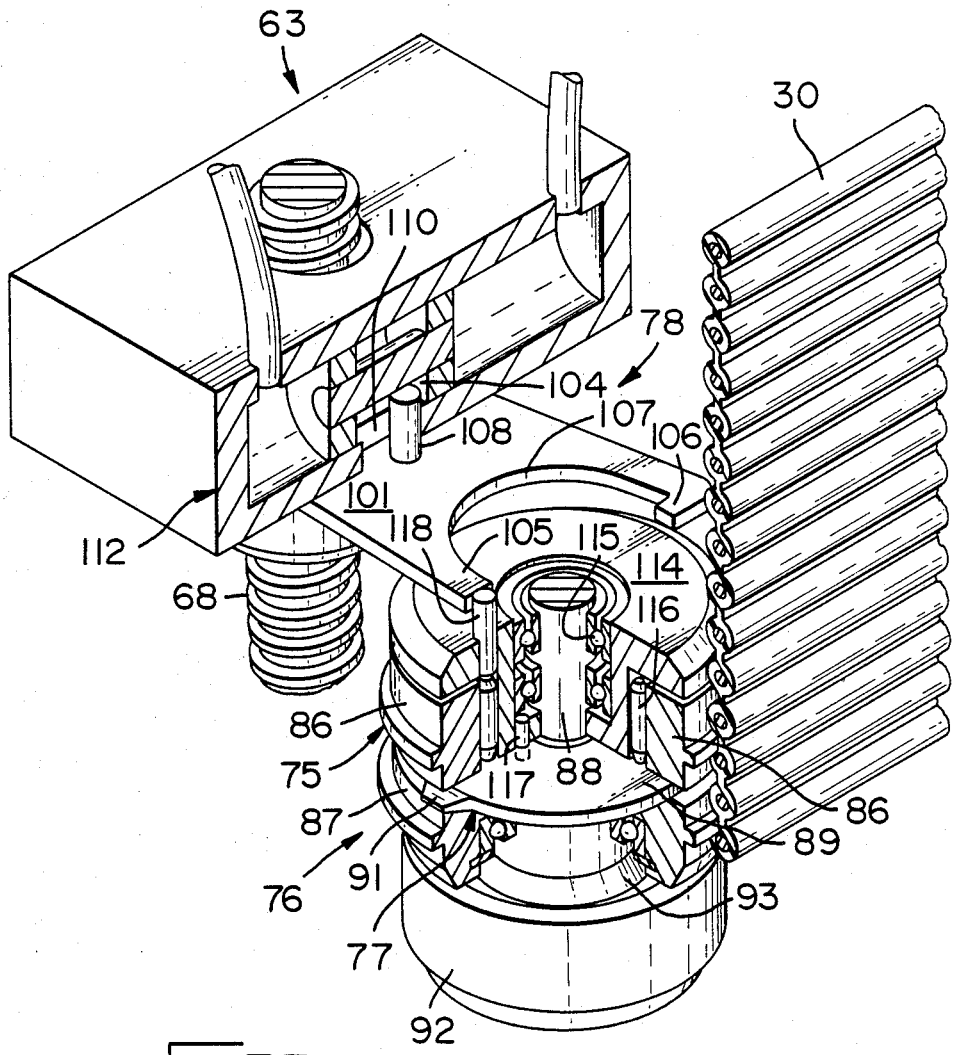
Figure 8:
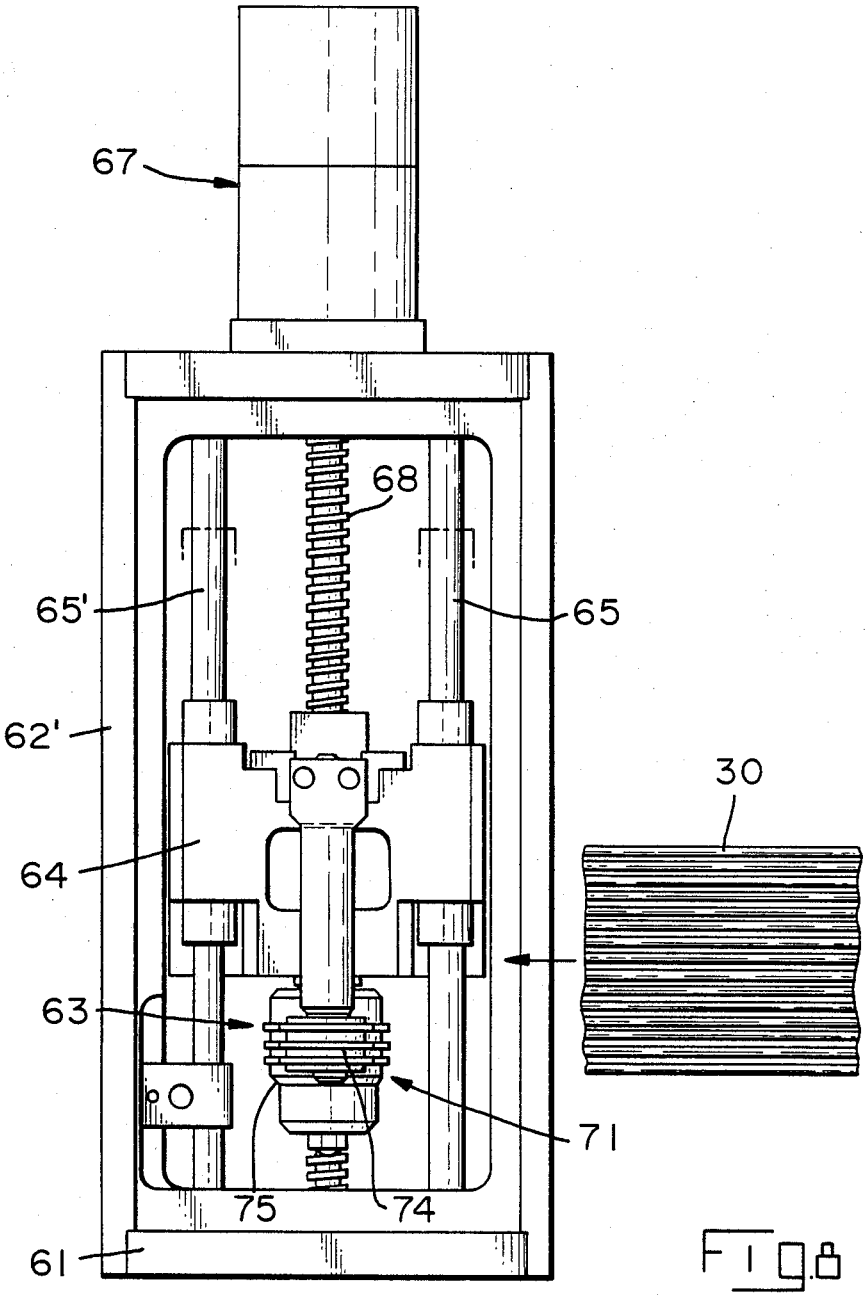
Figure 9:
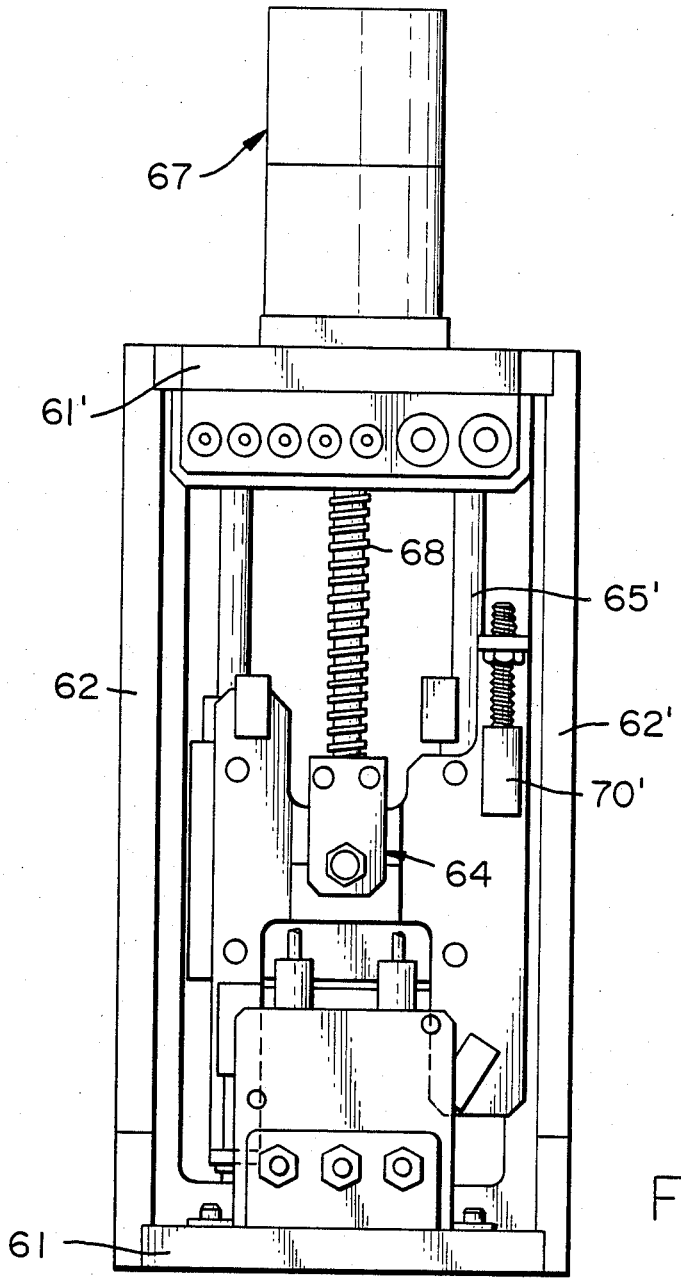
Figure 10A:
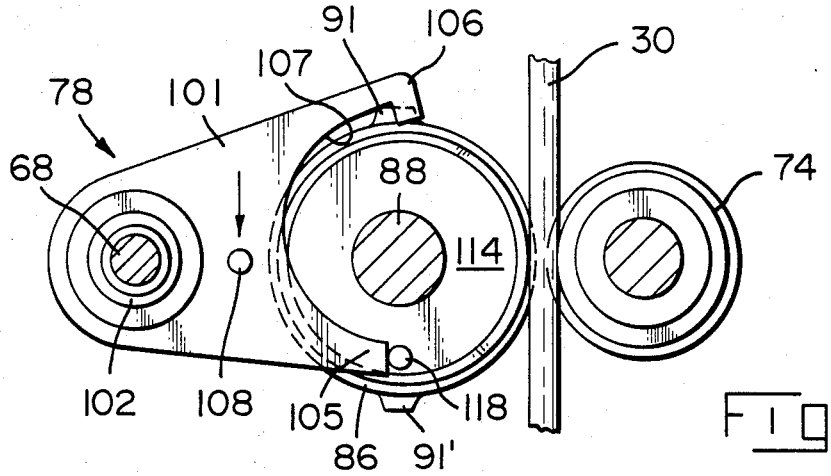
Figure 10B:
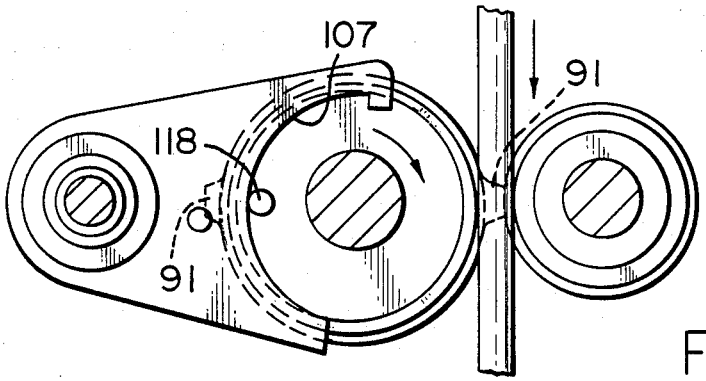
Figure 10C:
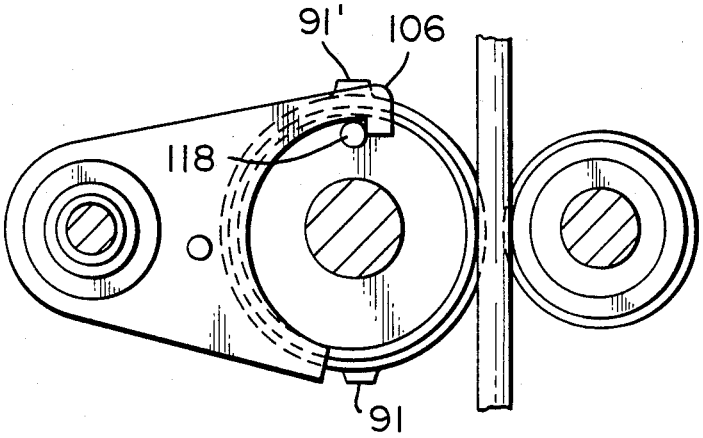
Figure 11:
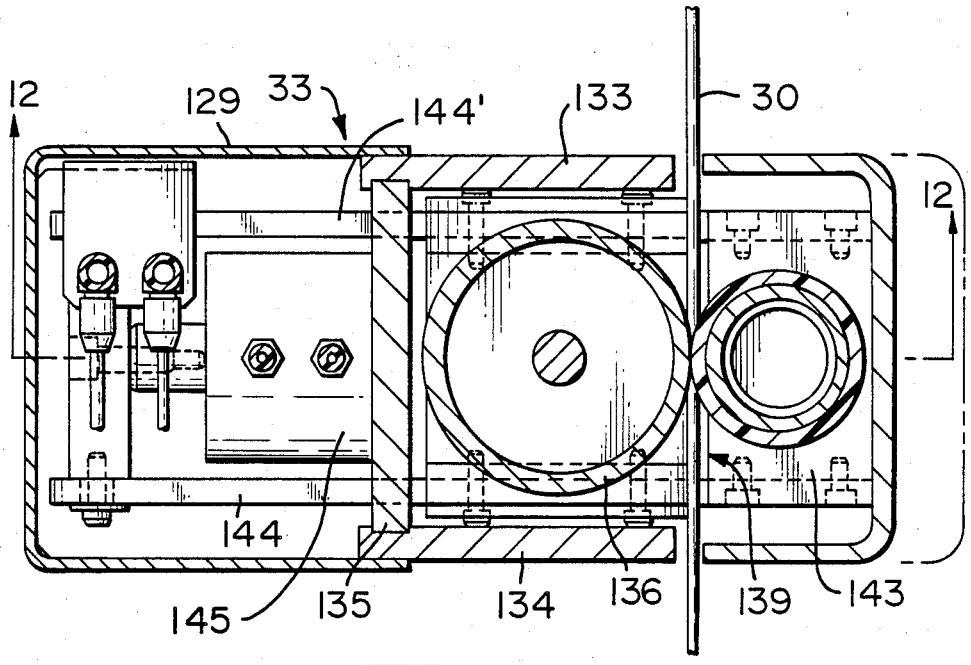
Figure 12:
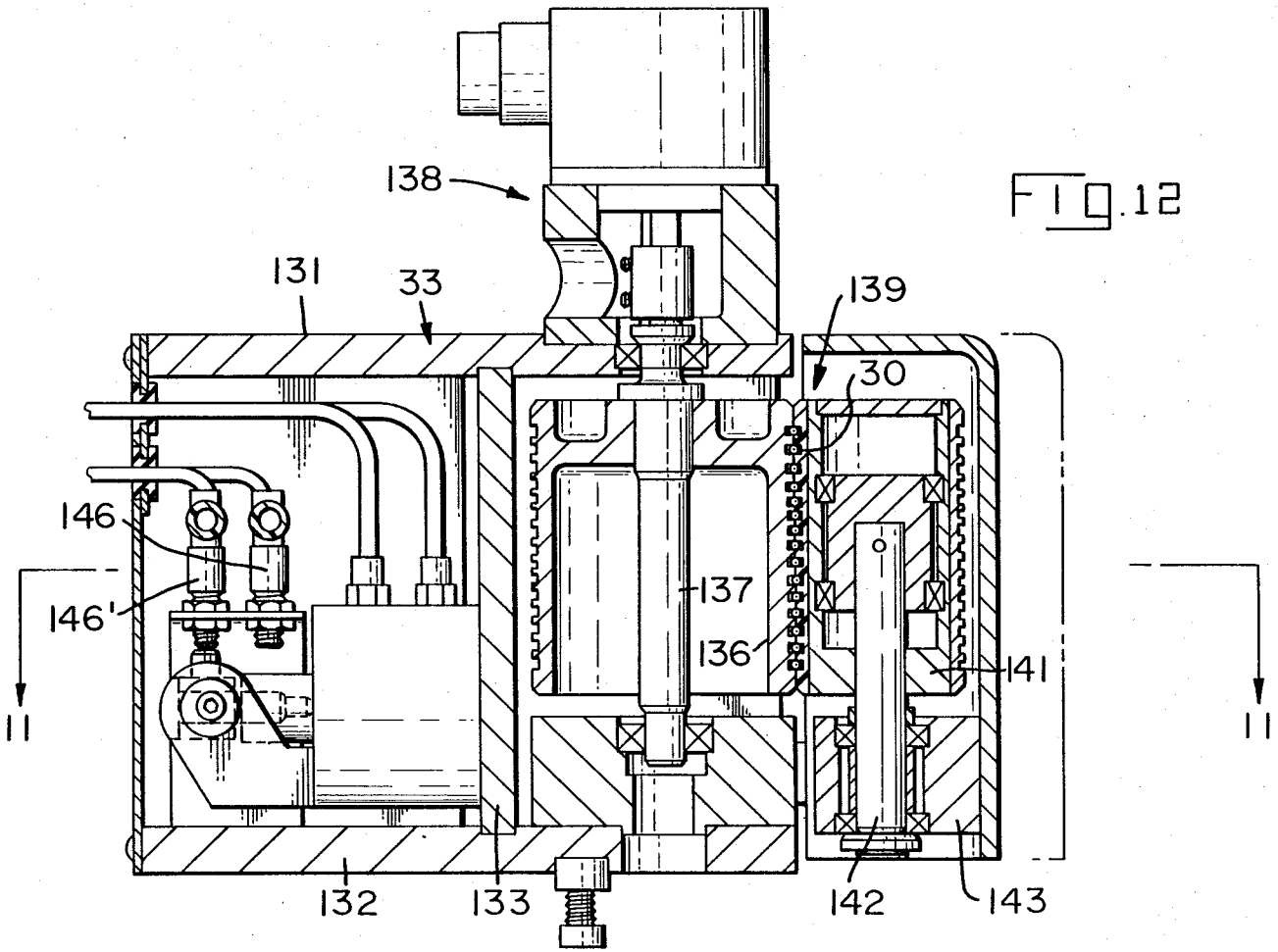
Figure 13:
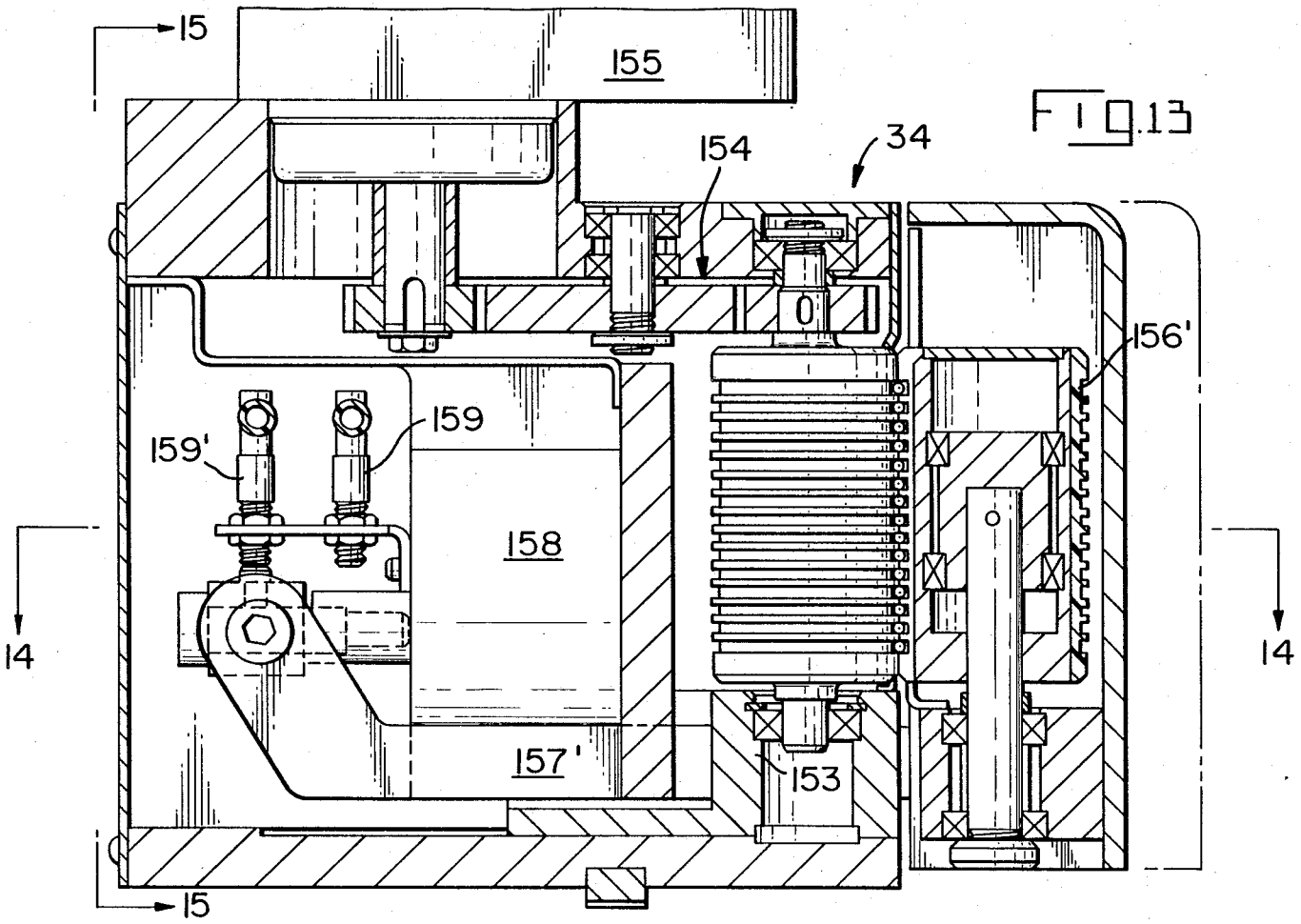
Figure 14:
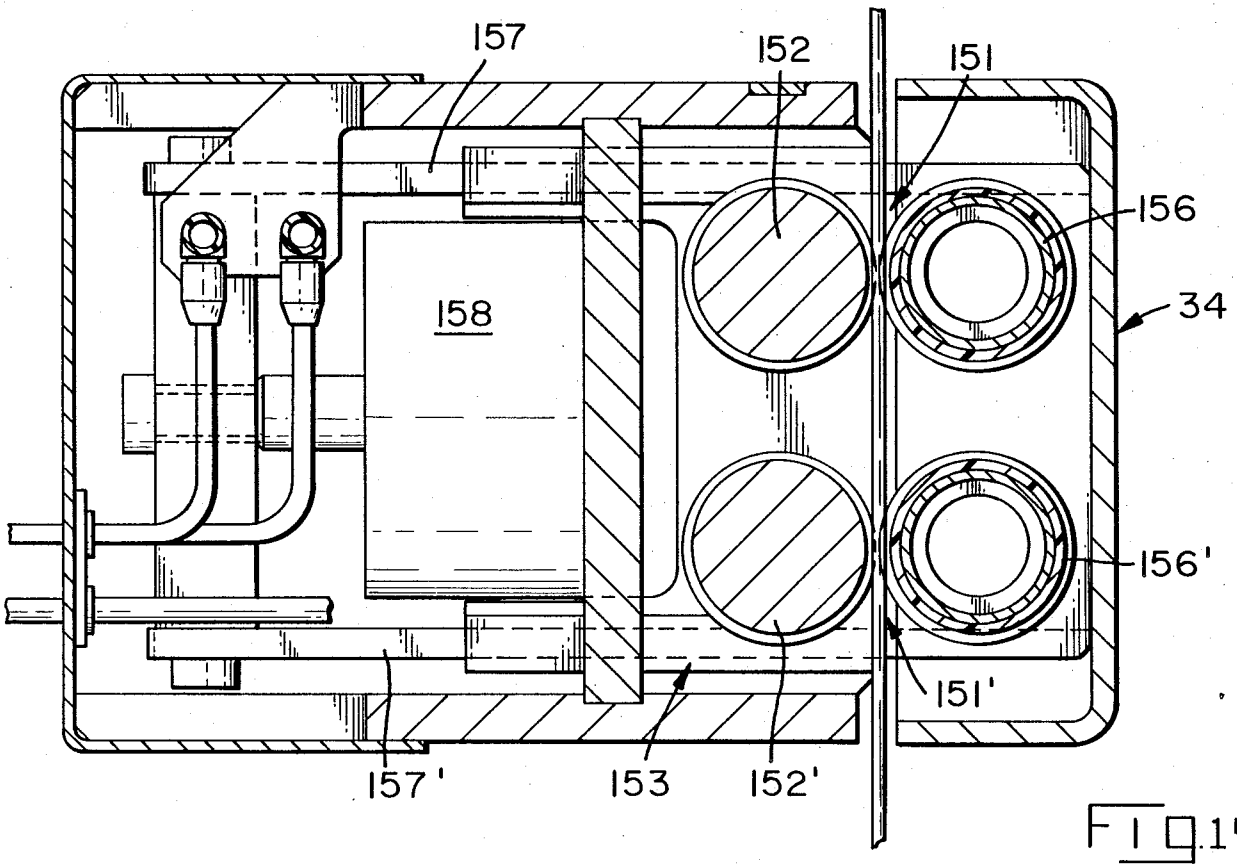
Figure 15:
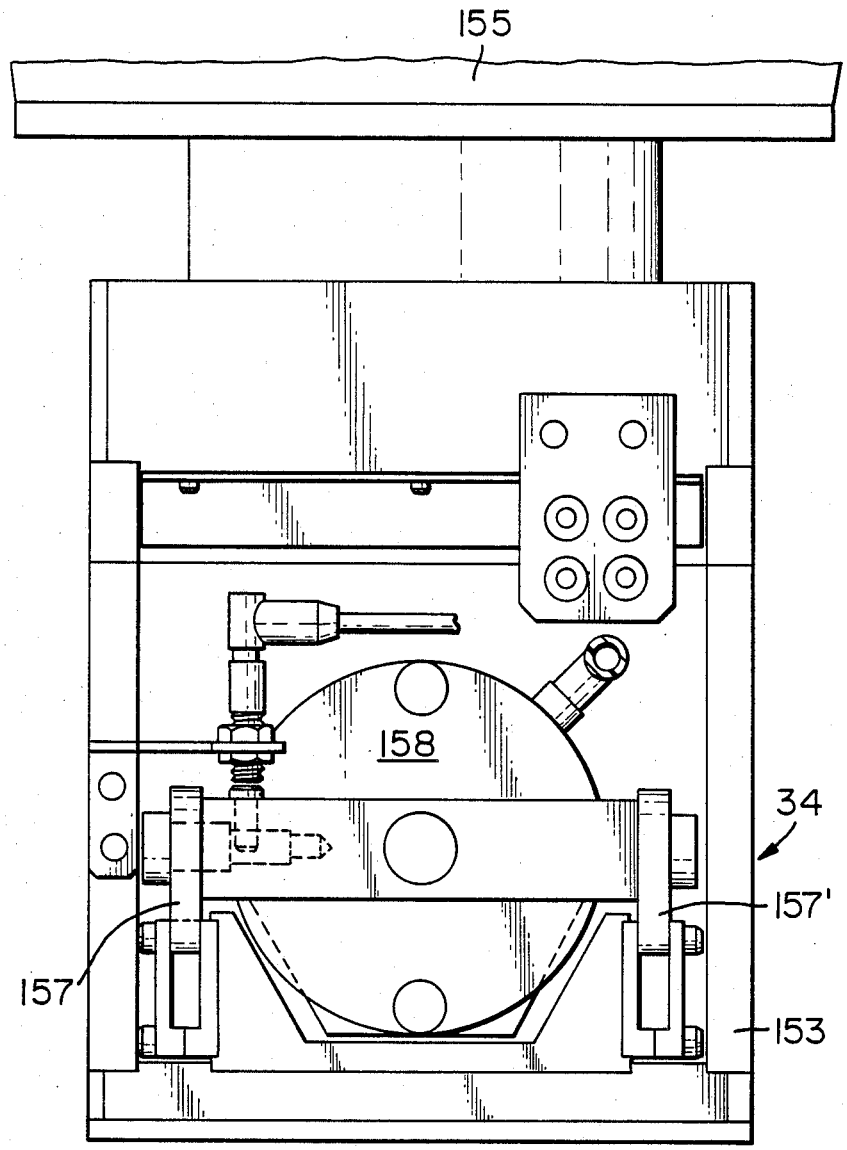
Figure 16:
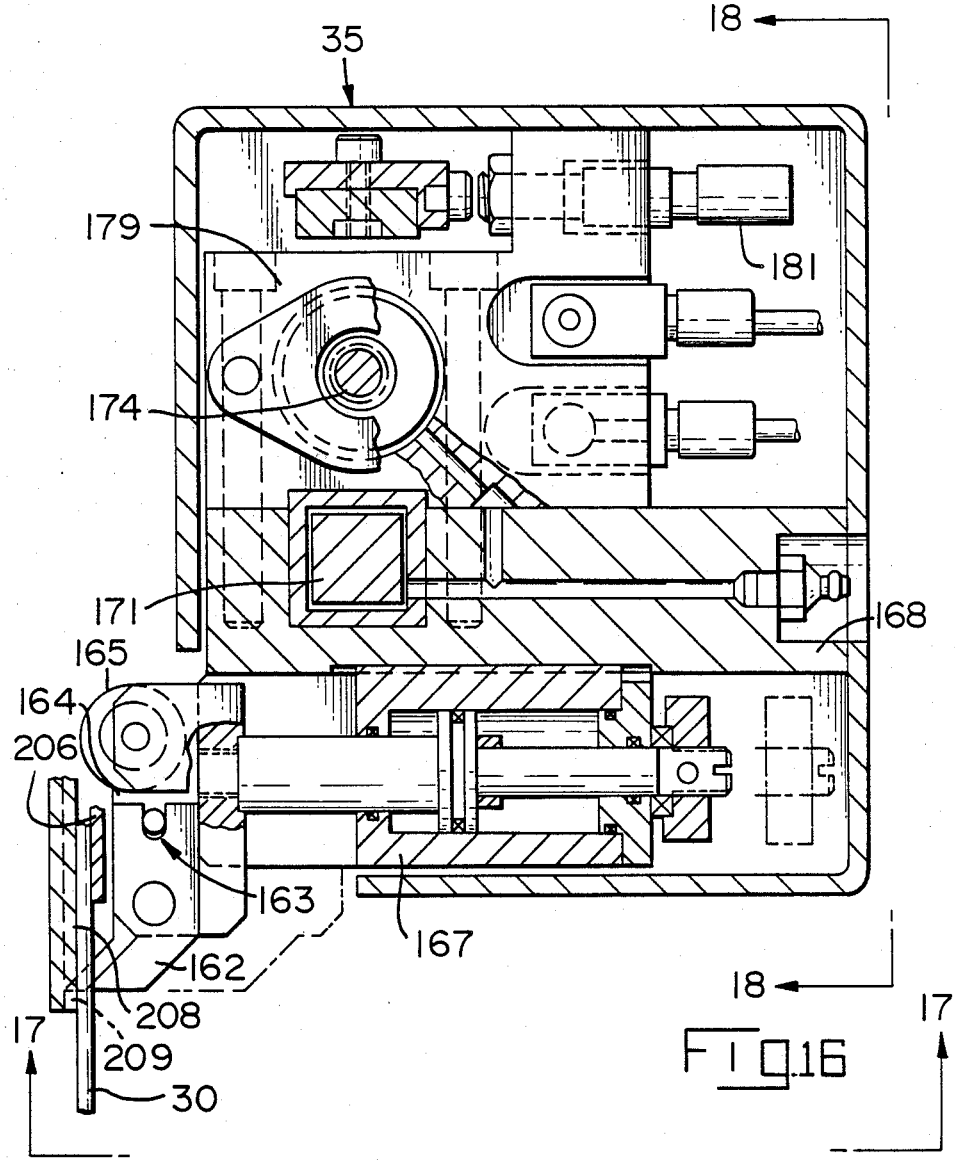
Figure 17:
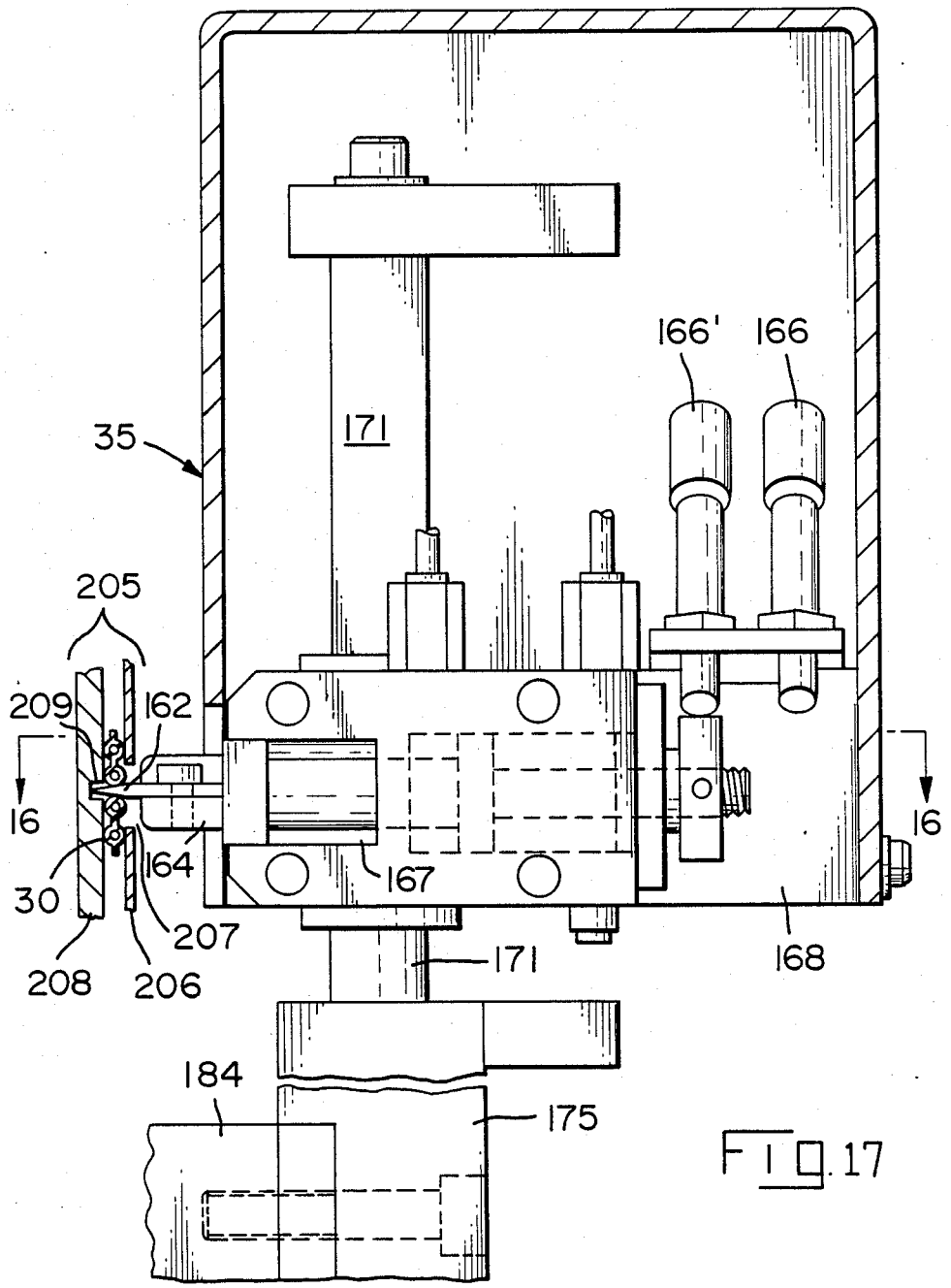
Figure 18:
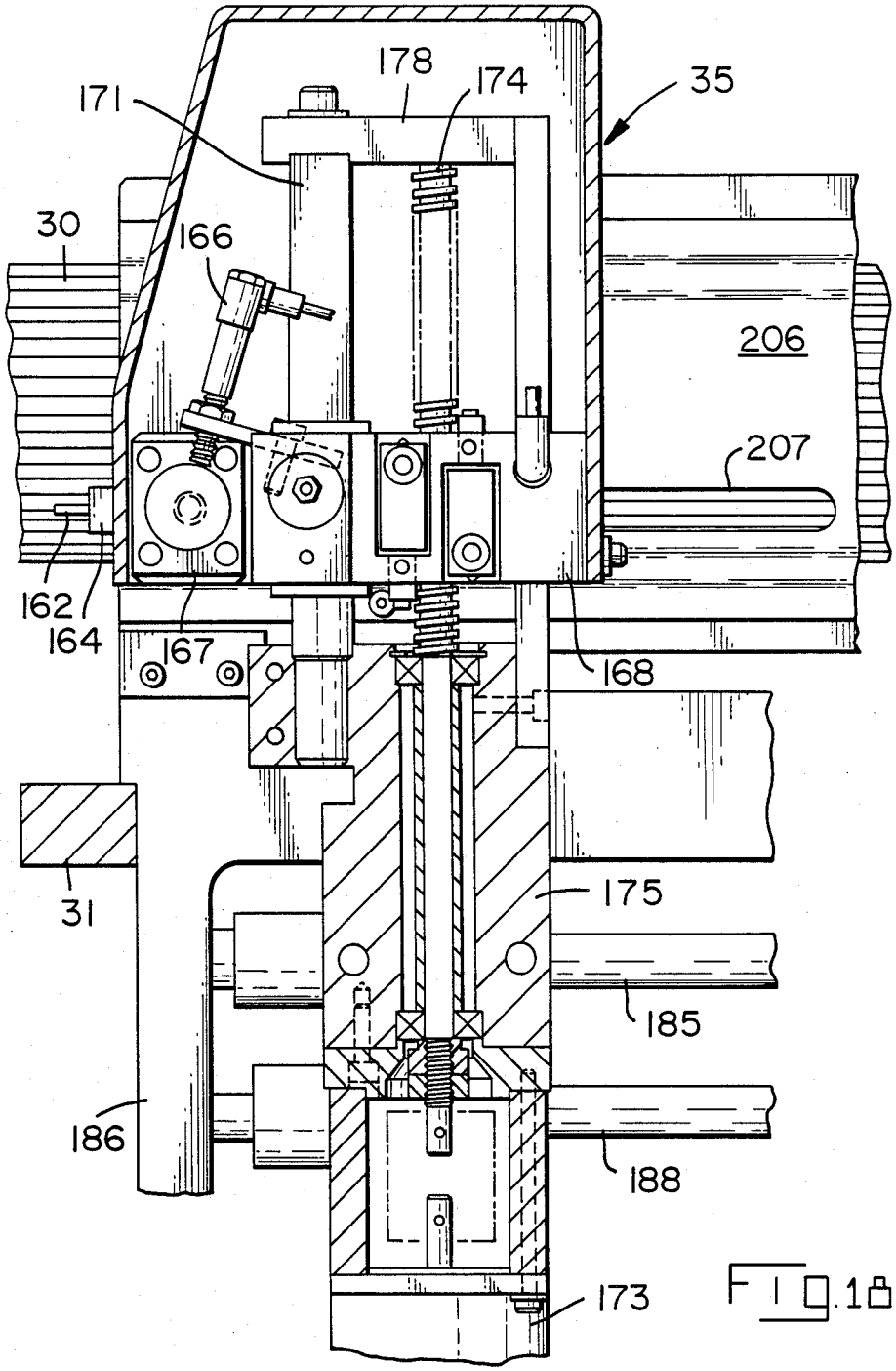
Figure 19:
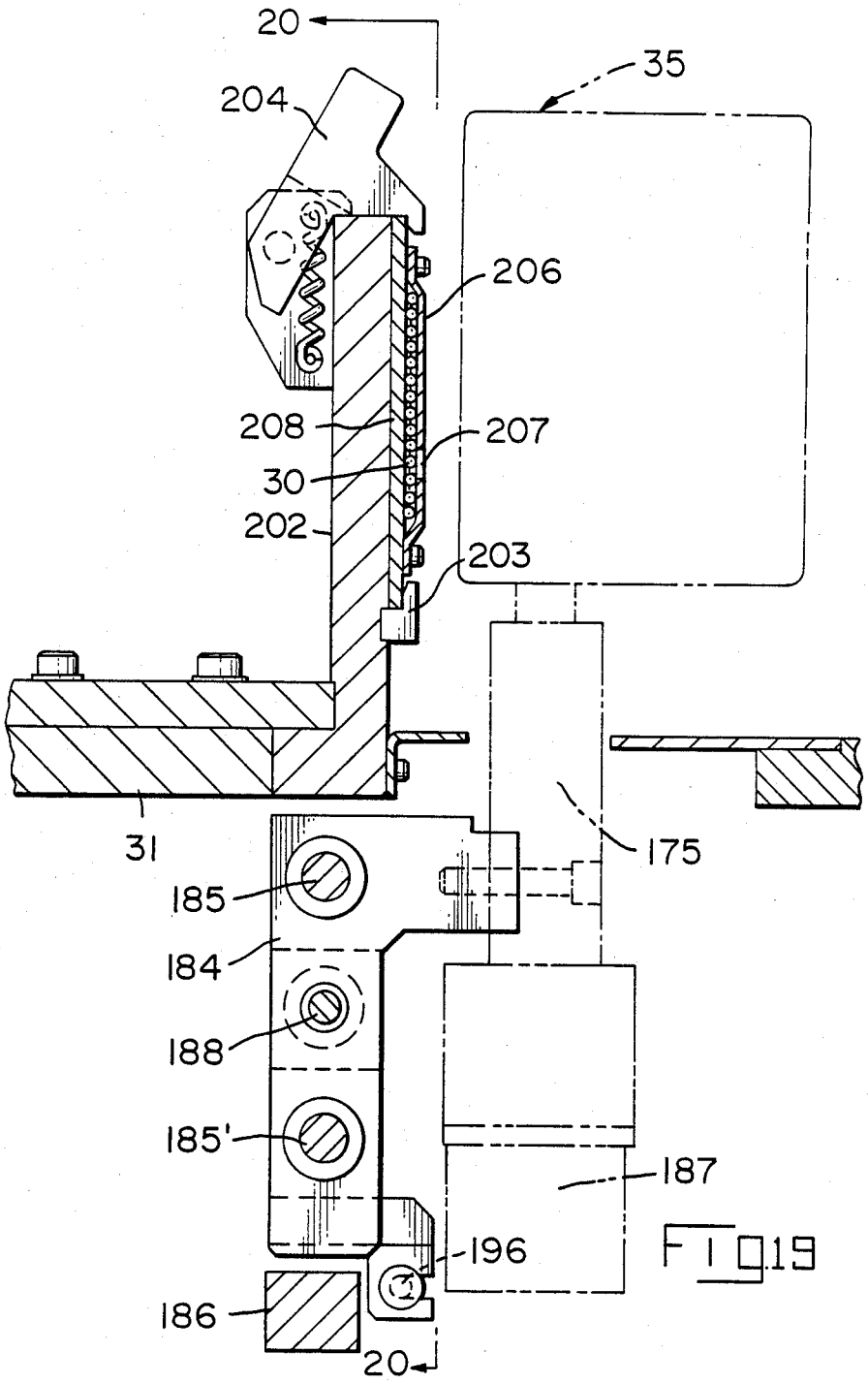
Figure 20:
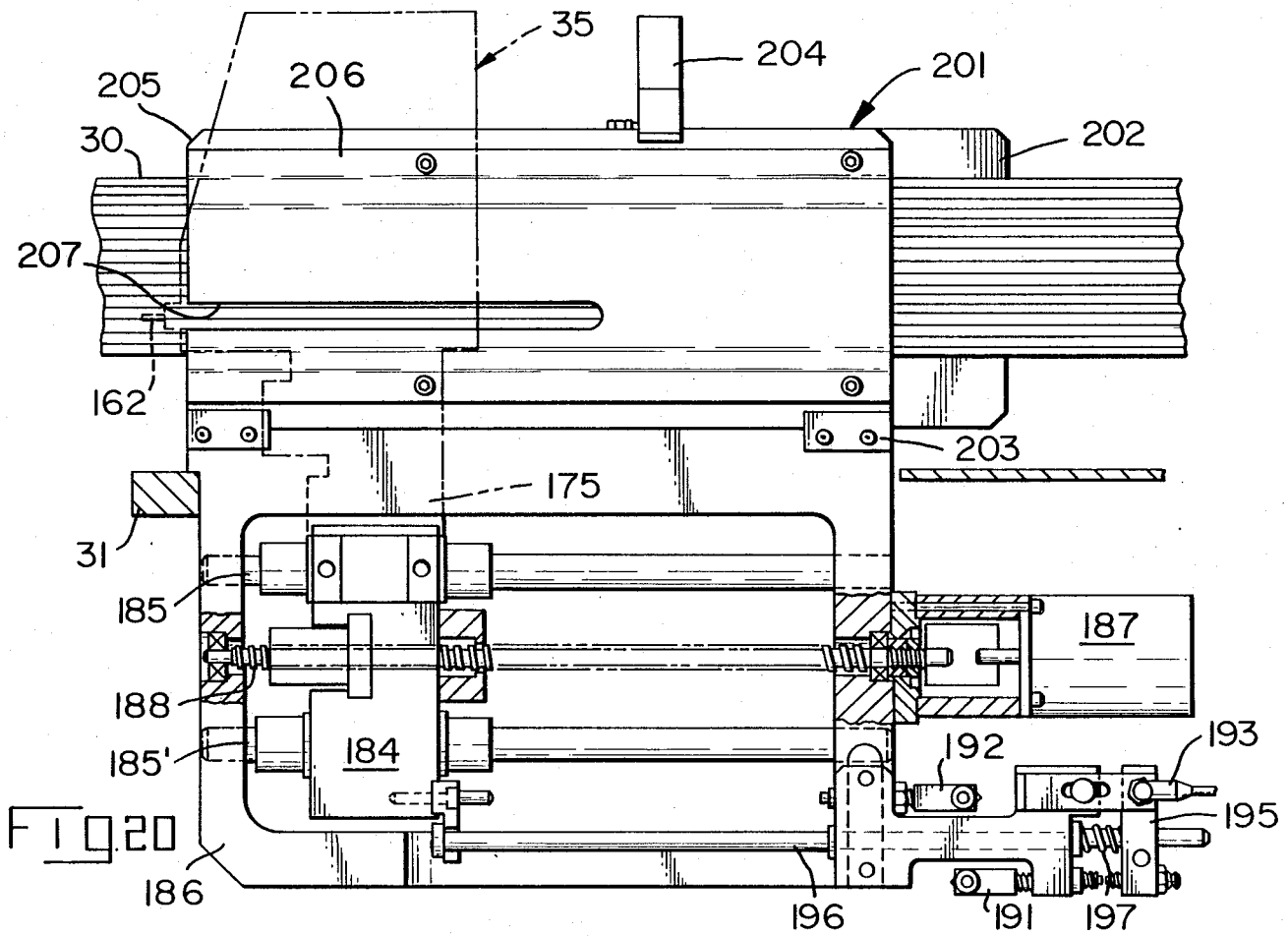
Figure 21B:
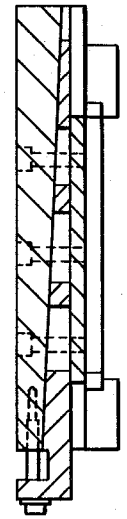
Figure 21A:
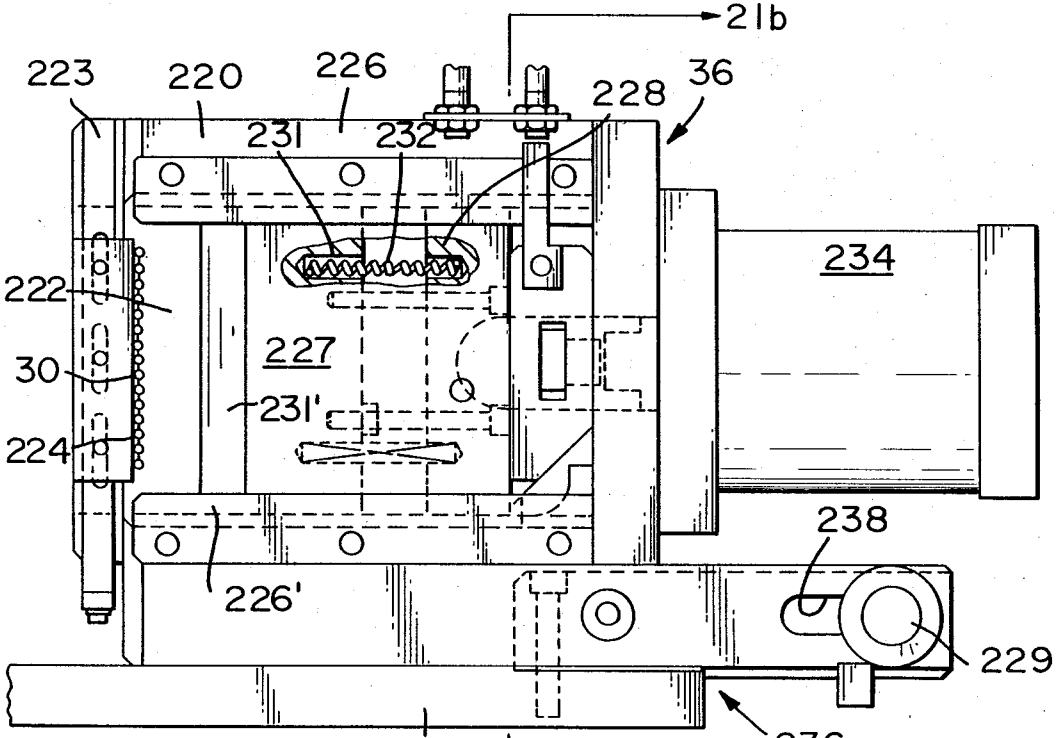
Figure 22:
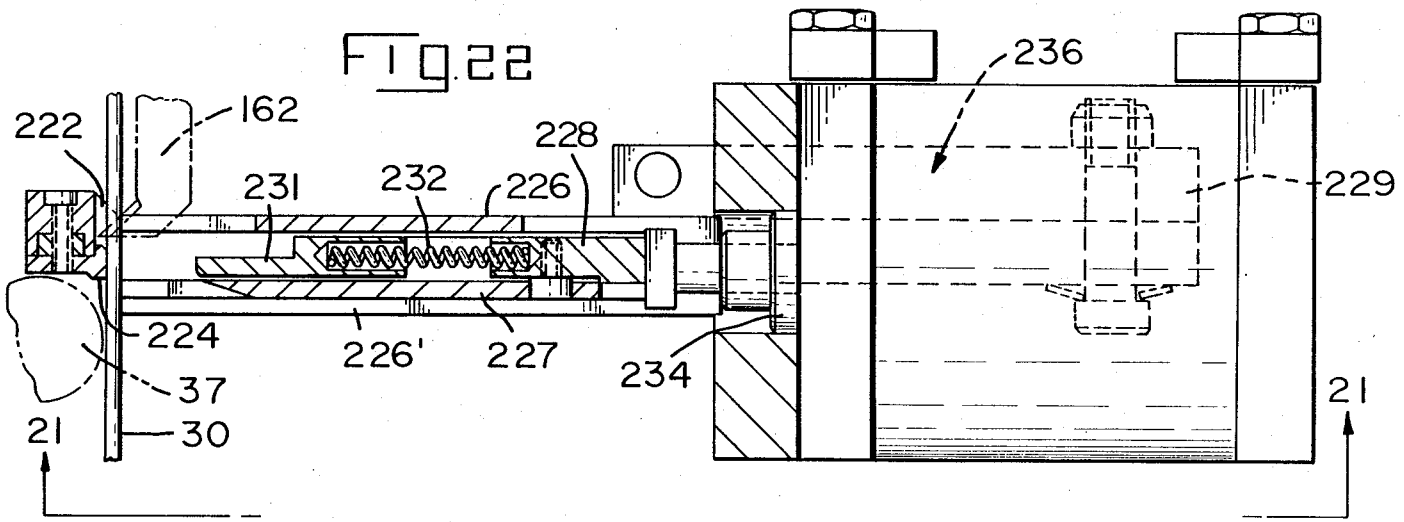
Figure 23:
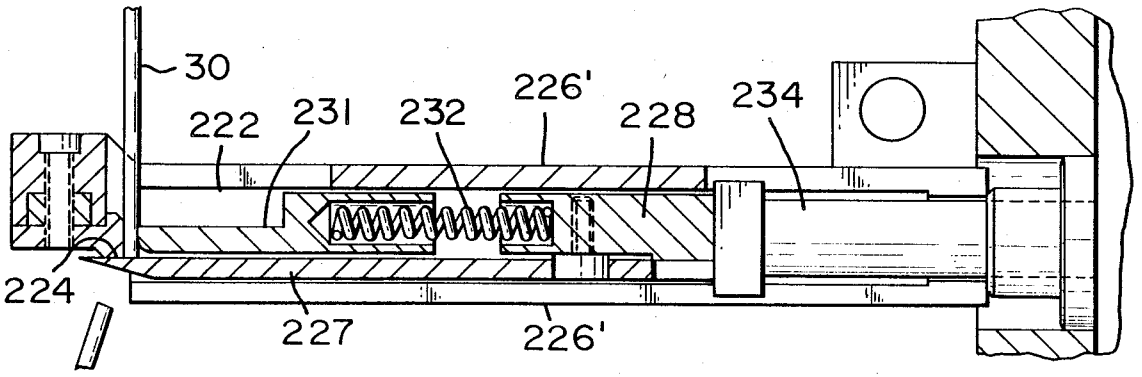
Figure 24A:
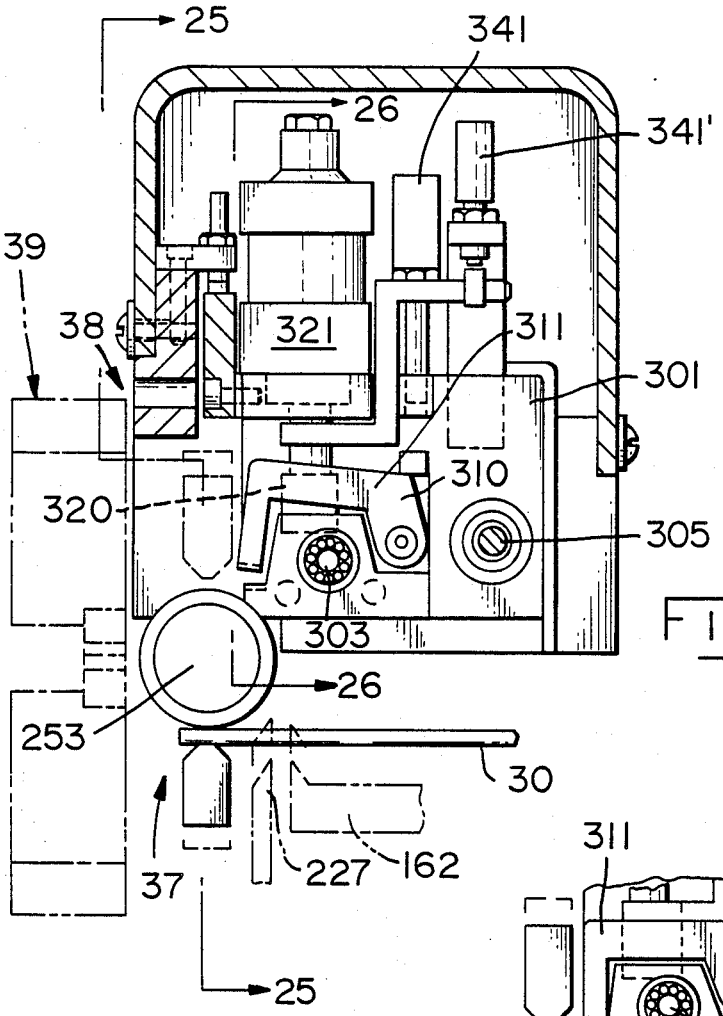
Figure 24B:
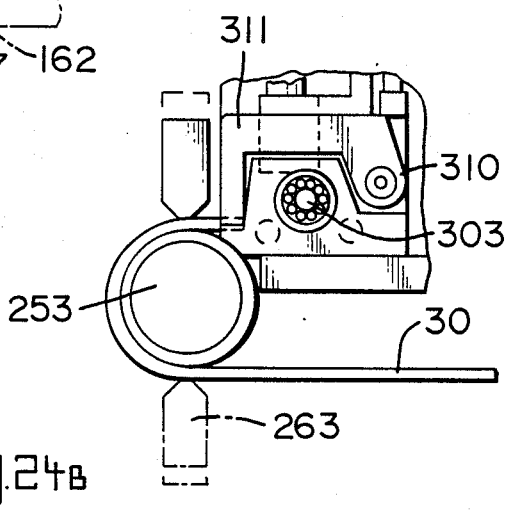
Figure 25:
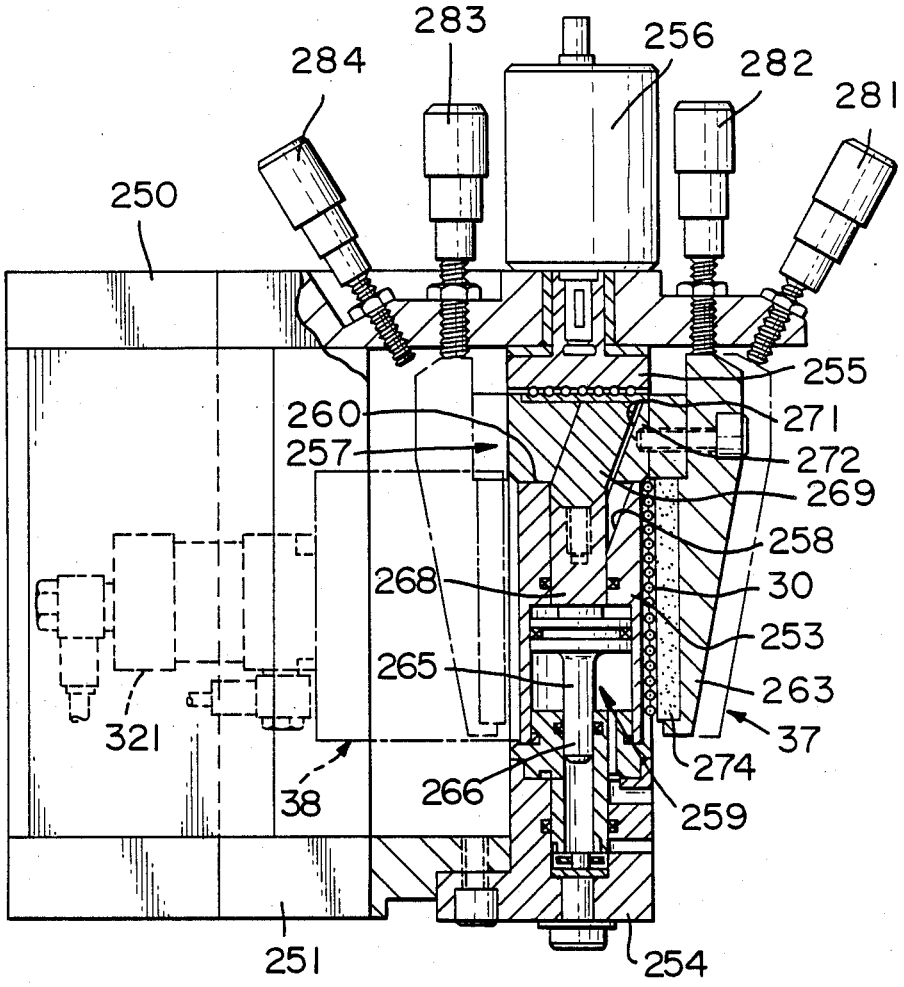
Figure 26:
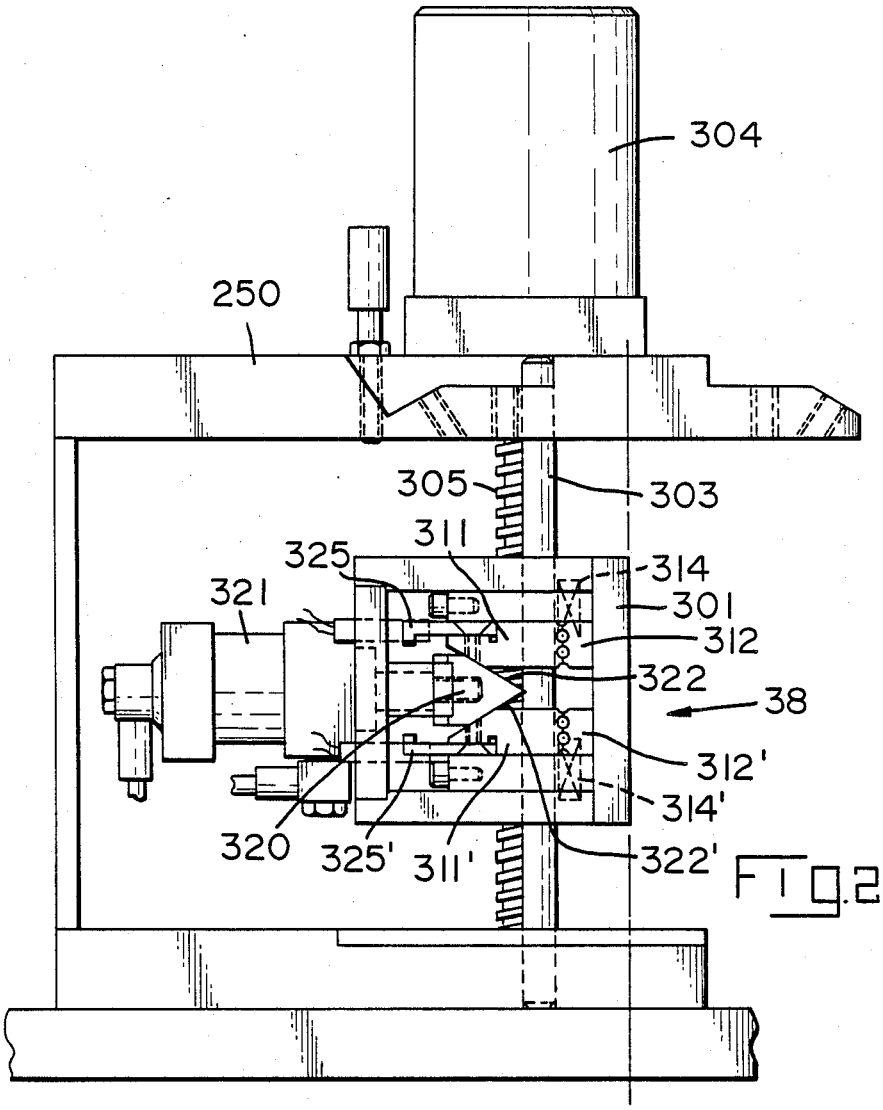
Figure 27:
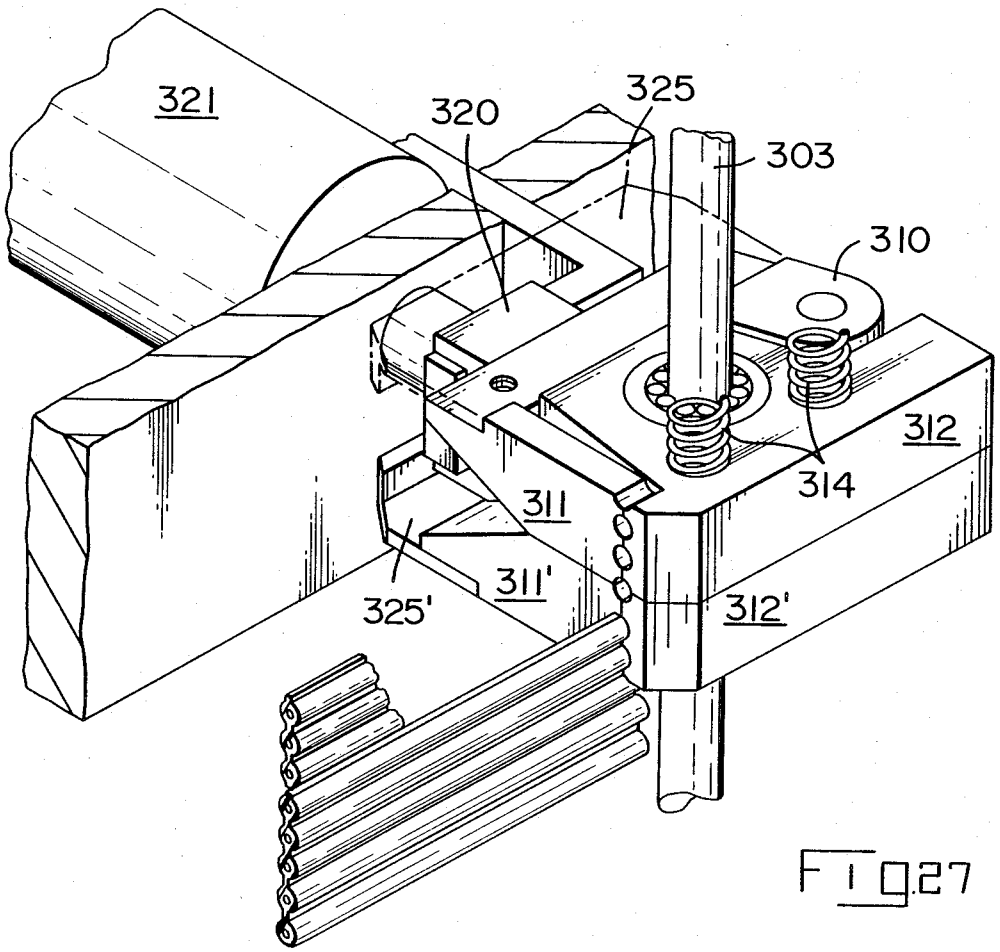
Figure 28A:
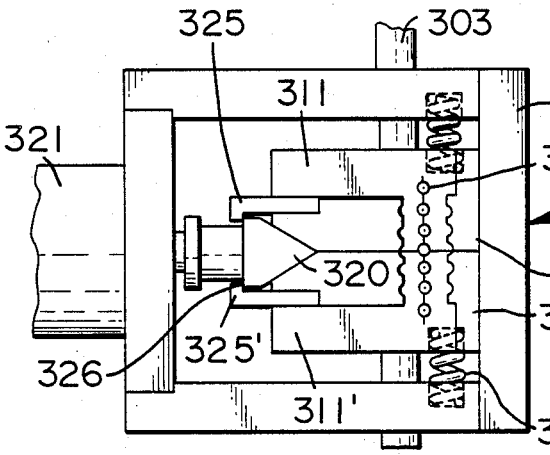
Figure 28B:
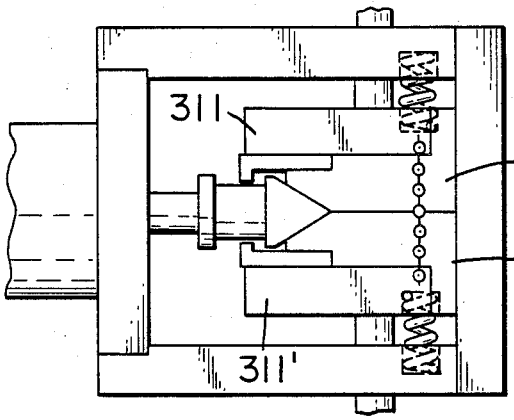
Figure 28C:
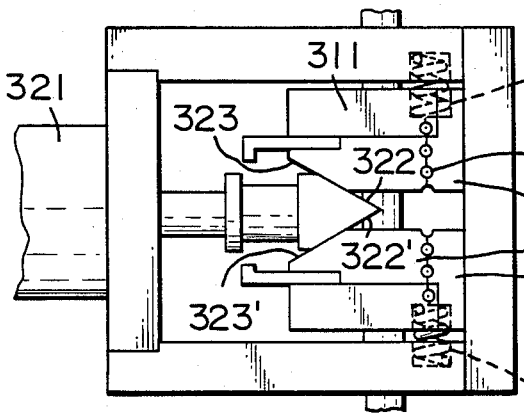
Figure 29:
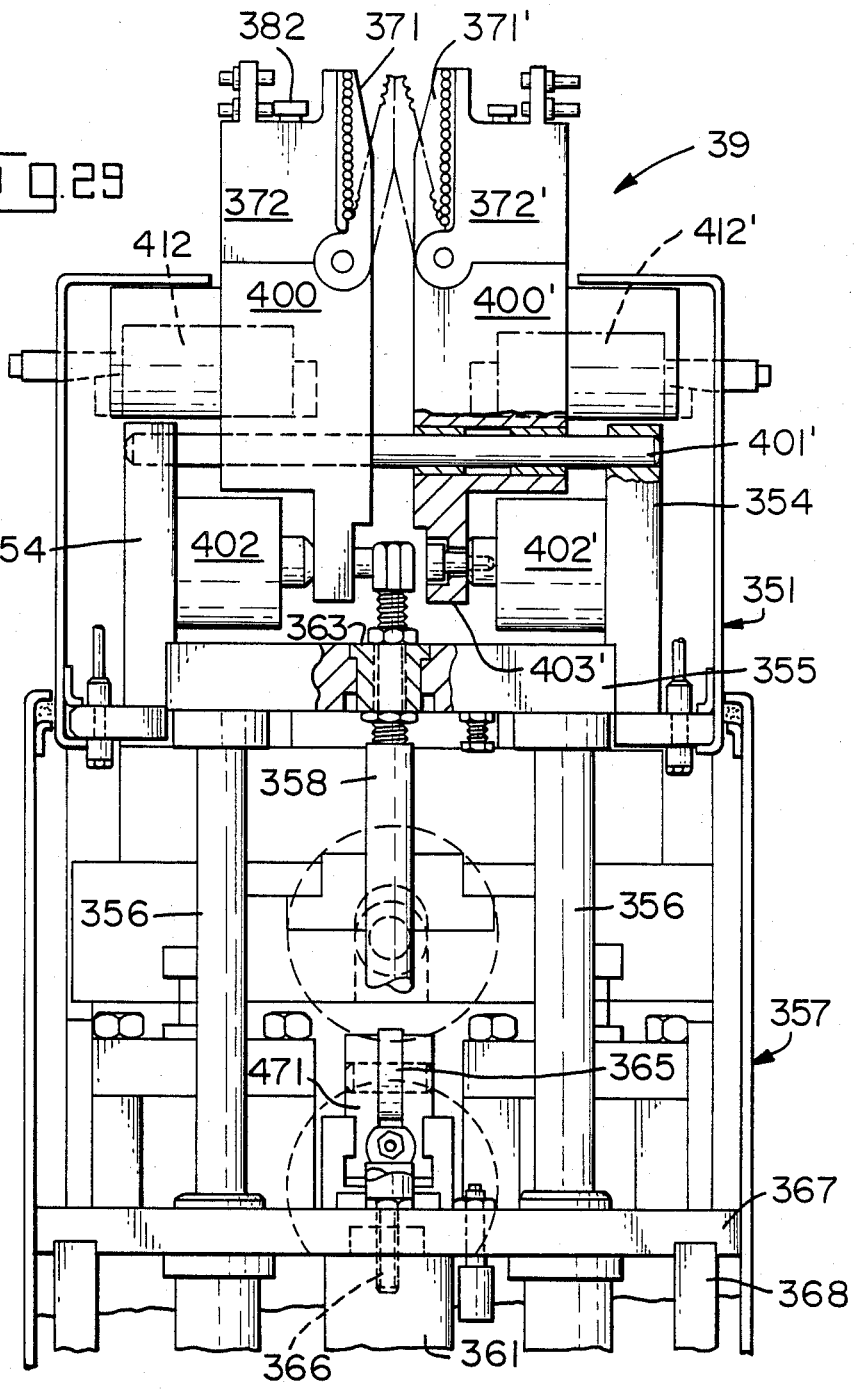
Figure 30:
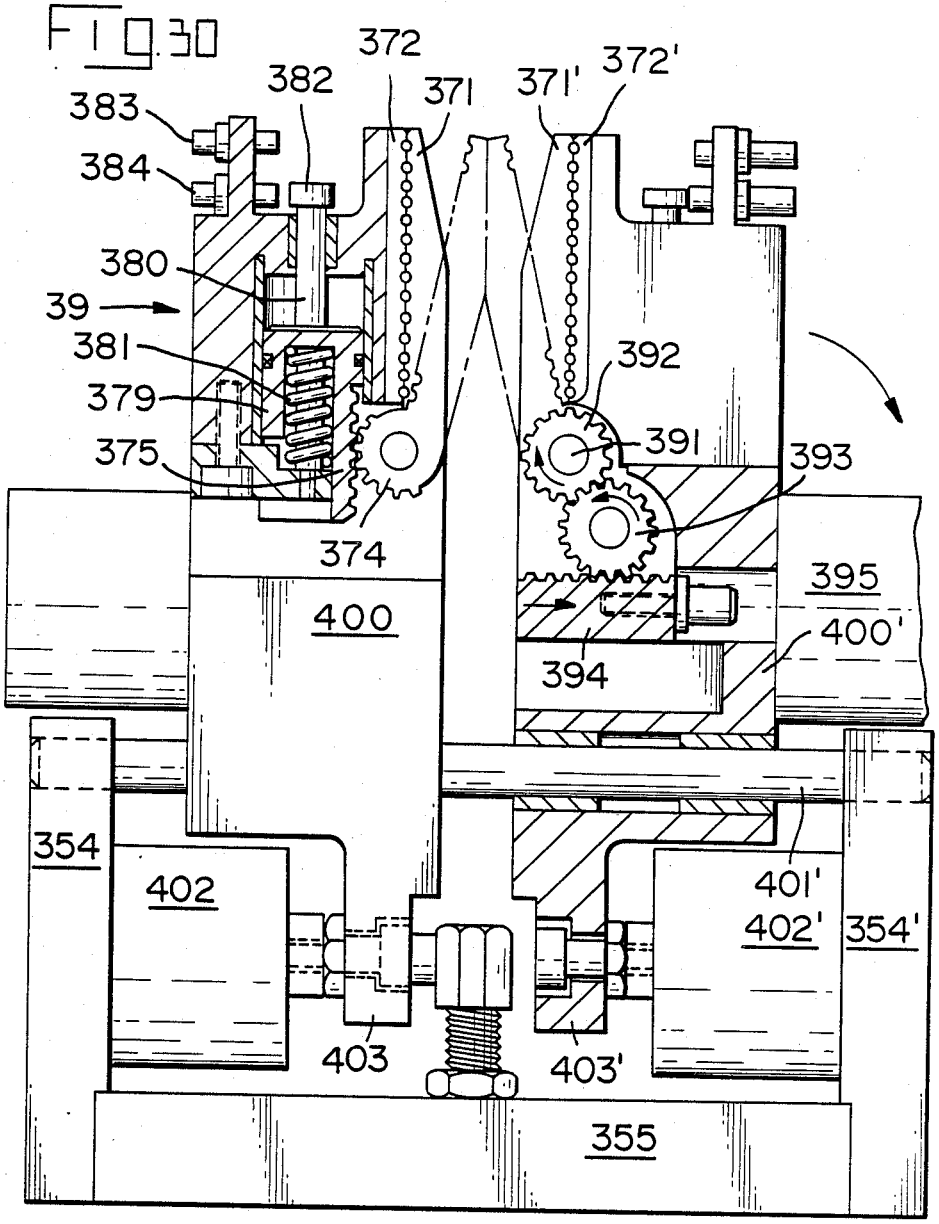
Figure 31:
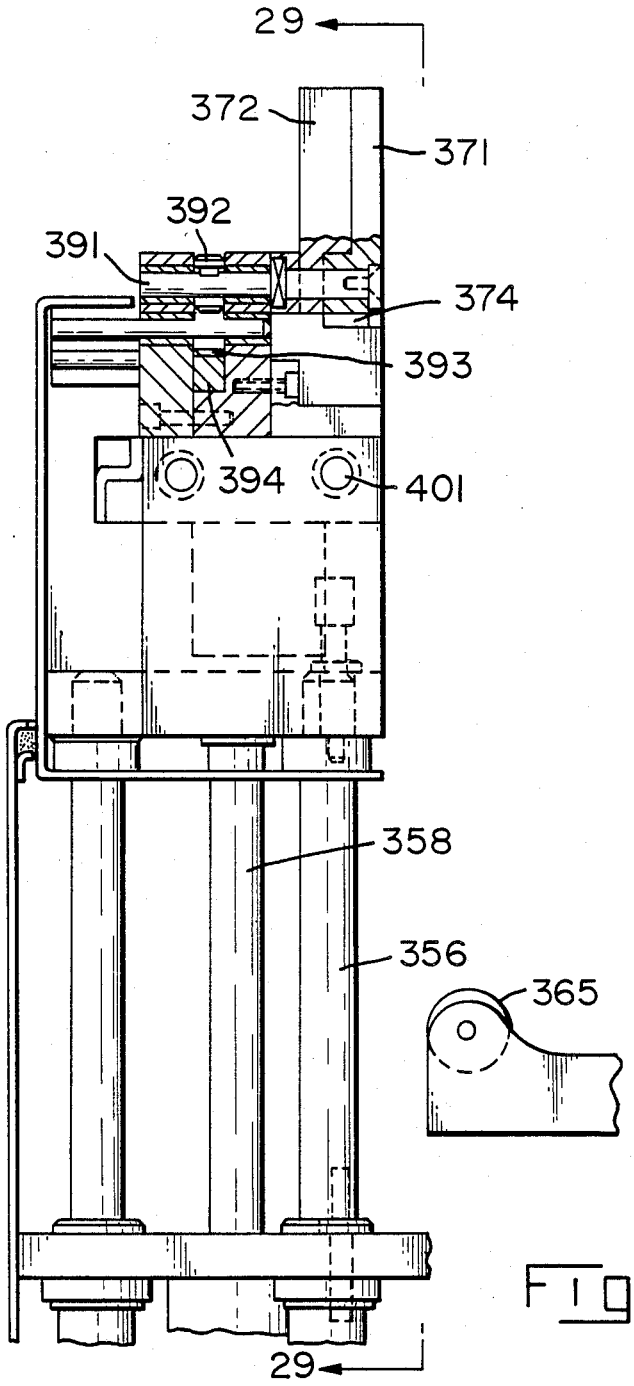
Figure 32:
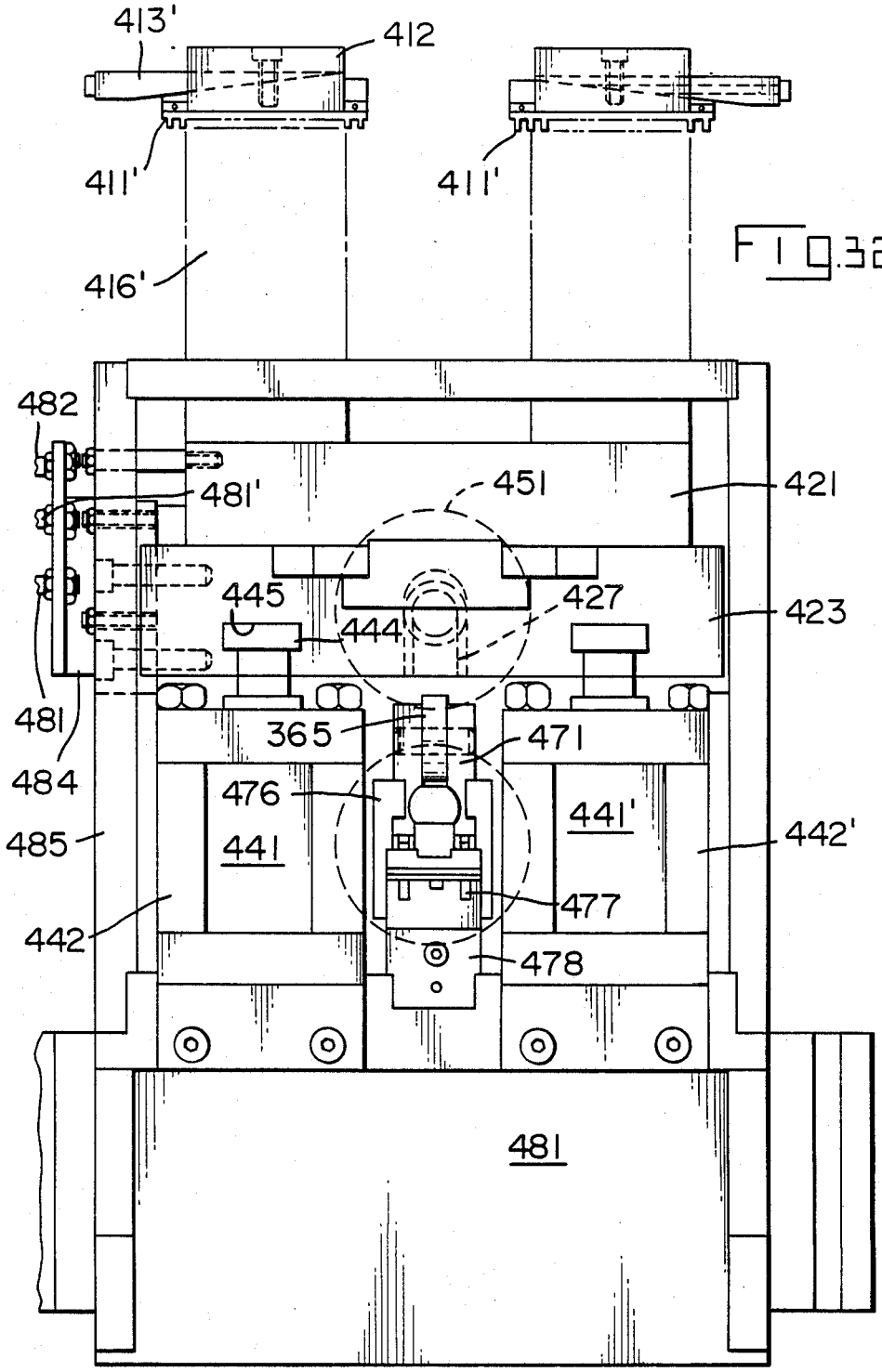
Figure 33:
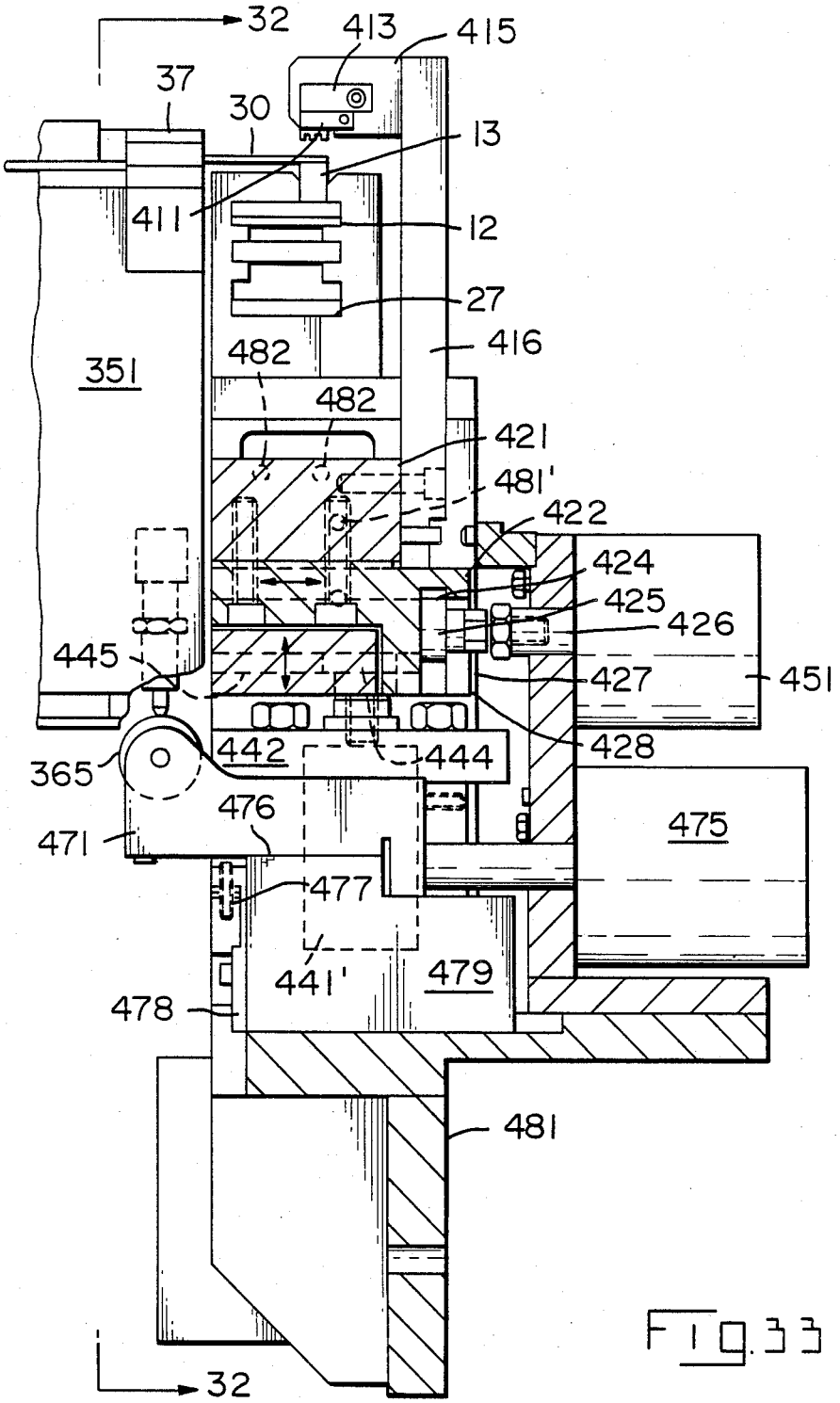
Figure 34:
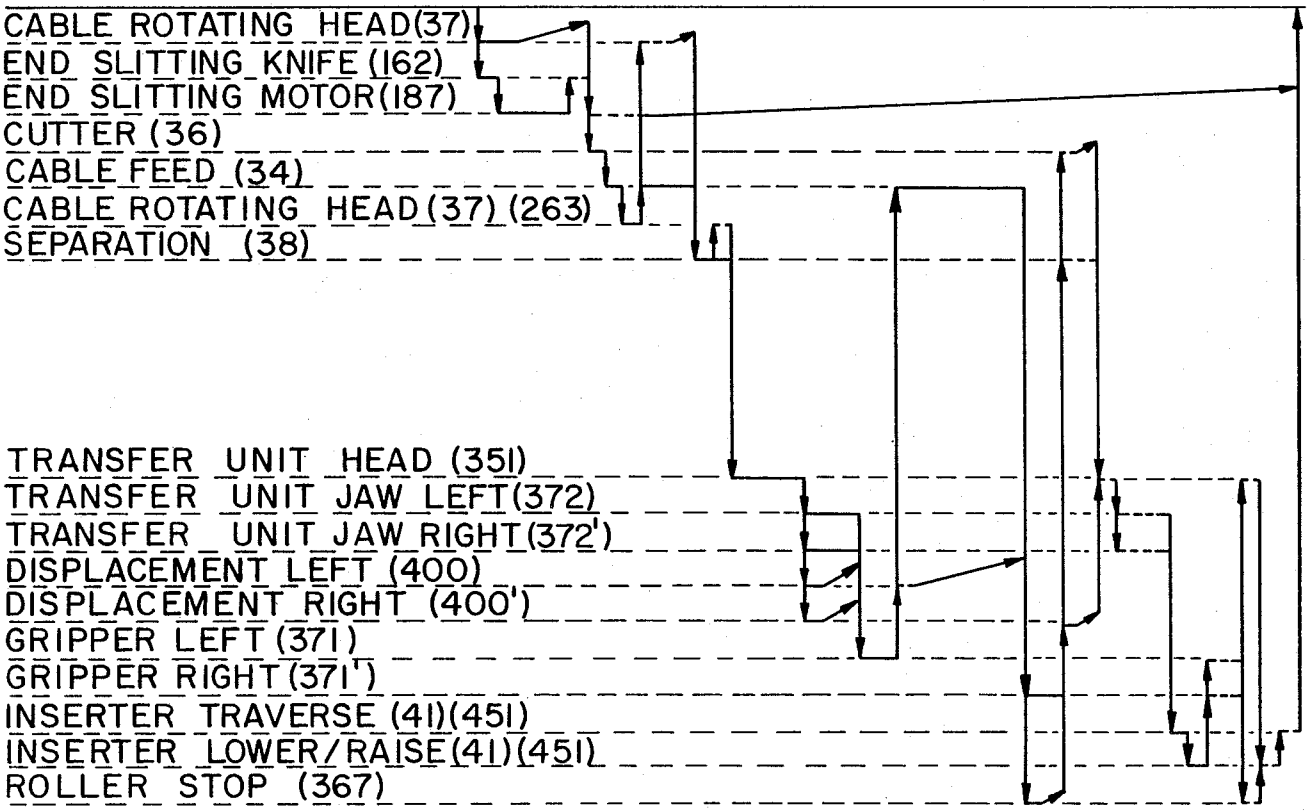

FIGS. 4*a*, 4*b* and 4*c* are schematic perspective views showing some of the different ribbon cable harnesses obtainable from the machine;

FIG. 5 is a cross-sectional view of the eye forming unit for providing slit-form eyes at intervals along the cable;

FIG. 6 is a view of part of the cable slitting mechanism of the eye forming unit partly in cross-section and to a larger scale;

FIG. 7 is a perspective view partly in section of a portion of the cable slitting mechanism;

FIG. 8 is an elevational view of the eye forming unit in the direction 8—8 in FIG. 5;

FIG. 9 is an elevation view of the eye forming unit in the direction 9—9 of FIG. 5;

FIGS. 10*a*, 10*b* and 10*c* are schematic views showing the operation of an escapement unit of the slitting mechanism before, during, and after a slitting operation;

FIG. 11 is a cross-sectional view of a cable measuring unit, taken in a horizontal plane along line 11—11 of FIG. 12;

FIG. 12 is a cross-sectional view of the cable measuring unit taken in a vertical plane along line 11—11 of FIG. 11;

FIG. 13 is a cross-sectional view of a cable feeding unit taken in a vertical plane;

FIG. 14 is a cross-sectional view of the cable feeding unit taken along line 14—14 of FIG. 13;

FIG. 15 is an end elevational view of the cable feeding unit in the direction 15—15 of FIG. 13;

FIG. 16 is a cross-sectional view of a slitting head of a cable end slitting unit taken in a horizontal plane along line 17—17 of FIG. 17;

FIG. 17 is a cross-sectional view of the slitting head taken along line 17—17 of FIG. 16;

FIG. 18 is an elevational view of the end slitting head in the direction 18—18 of FIG. 16 with a housing cover removed and partially in cross-section;

FIG. 19 is a cross-sectional view of a cable guide showing the relative disposition of the cable end slitting unit in broken lines;

FIG. 20 is an elevational view of the drive mechanism of the slitting head which is shown in phantom;

FIG. 21A is an elevational view of a cable cutting mechanism in the direction 21—21 of FIG. 22;

FIG. 21B is a sectional view taken in the direction 21*b*—21*b* of FIG. 21A;

FIG. 22 is a cross-sectional view of a blade assembly portion of the mechanism taken along line 22—22 of FIG. 21 and with the cutting blade withdrawn;

FIG. 23 is an enlarged cross-sectional view of the blade assembly with the cutting blade advanced through the cable;

FIGS. 24*a* and 24*b* are plan views of a cable rotating unit and an associated cable end gripping and separating mechanism in cable-receiving and rotated conditions respectively;

FIG. 25 is a cross-sectional view of the rotating unit;

FIG. 26 is an elevational view of the cable end gripping and separating unit (associated with the cable rotating unit) in a cable separating condition;

FIG. 27 is ia perspective view of part of the unit of FIG. 26 in a cable-gripping condition;

FIGS. 28*a*, 28*b* and 28*c* are elevational views of the cable gripper and separator in cable-receiving, cable-gripping, and cable-separating conditions, respectively;

FIG. 29 is a front elevational view of a cable transfer unit taken in the direction 29—29 of FIG. 31;

FIG. 30 is a front elevational view of cable transfer jaws and operating mechanism of the transfer unit;

FIG. 31 is a side view of the transfer unit partly in cross-section;

FIG. 32 is a front elevation of a cable insertion unit in the direction 32—32 of FIG. 33;

FIG. 33 is a side elevation of the cable insertion unit;

FIG. 34 is a timing diagram of one mode of operation of the cable handling unit; and FIGS. 35*a* through 35*l* are schematic views of various stages of operation of the cable handling unit.

It will be appreciated that in the interest of clarity and ease of understanding of the drawings, selected background detail has been omitted from some views in addition to conventional elements such as air feed lines, position sensors, etc., the construction and disposition of which are well understood.

Figure 1:
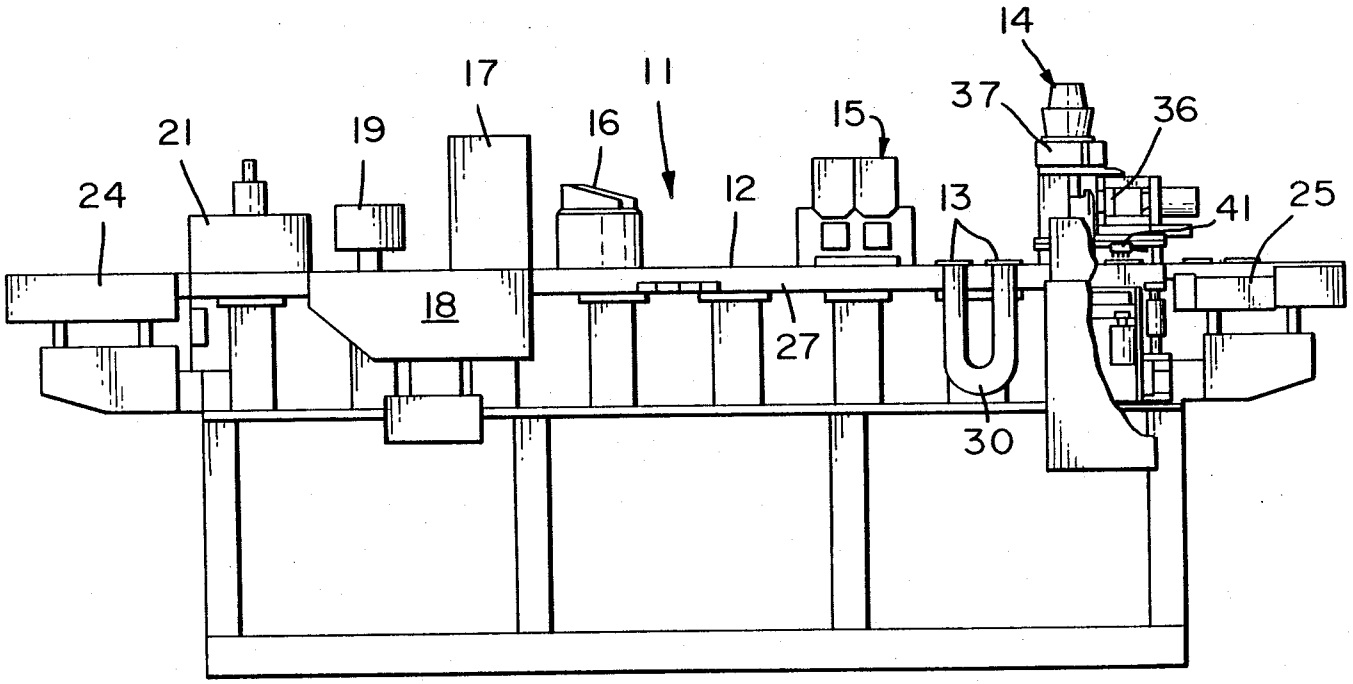
FIG. 1 is a schematic front elevational view of the harness making machine.
Figure 2:
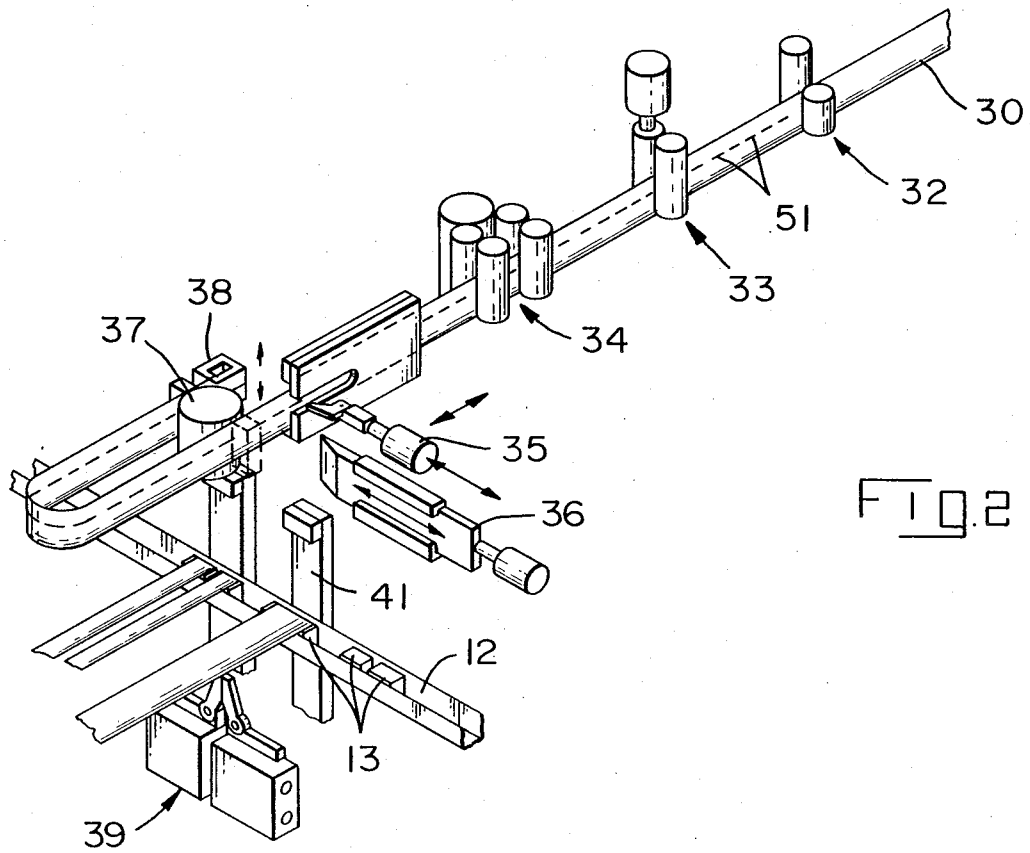
FIG. 2 is a schematic perspective view of a cable handling unit.
Figure 3:
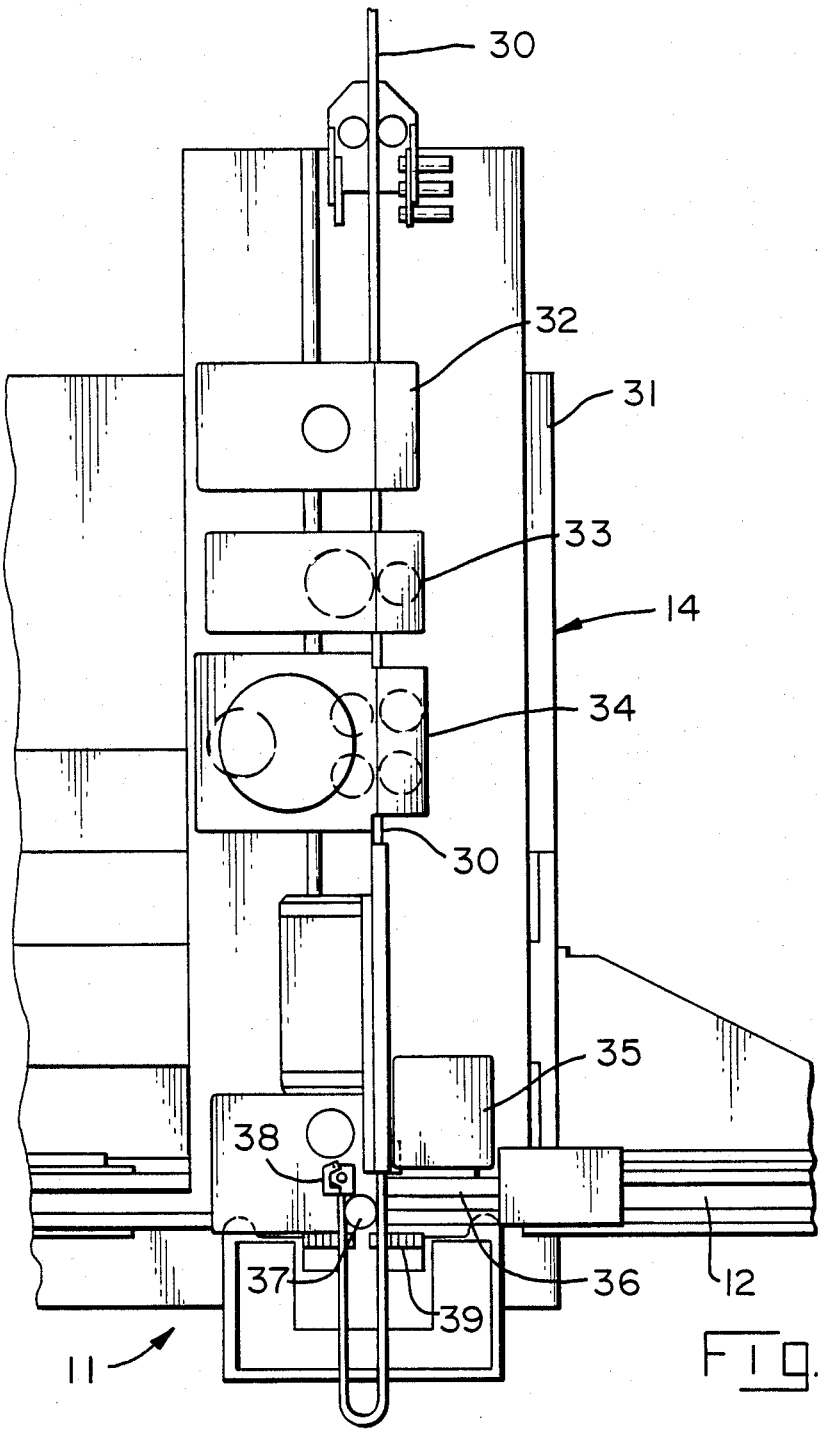
FIG. 3 is a schematic plan view of the cable handling unit.

As shown particularly in FIGS. 1, 2 and 3, the harness making apparatus comprises a connector transfer unit 11 having a connector feed path 12 along which pairs of connectors 13 are shunted on pallets sequentially past a series of operating units. A closely similar transfer unit is described in U.S. Pat. No. 4,552,260, the disclosure of which is incorporated herein by reference, and the present unit will not therefore be described herein in detail. The operating units comprise a cable handling unit 4, a housing closure insertion unit 15, marking 16, 19, ejection control 17, and test units 18, and a connector supply unit 21 feeding connectors 13 onto pallets on the downstream end of the feed path 12. A pallet return path 27 extends under the feed path 12 and pallet lifts 24 and 25 respectively are provided at each end of the feed path to lower and raise respective pallets carrying fresh connectors from the downstream end of the feed path onto the return path 27 and from the return path 27 onto the feed path 12 at the upstream end.

The cable handling unit 14 comprises a support frame 31 extending transversely of the connector feed path 12 on which are mounted, in the direction of travel of cable 30, an eye forming unit 32, a cable measuring unit 33, a cable feeding or drive unit 34, a cable end slitting unit 35, a cable severing unit 36, a cable rotating unit 37, a cable separating unit 38, a cable transfer unit 39, and a cable insertion unit 41.

In operation of the cable handling unit 14, briefly stated, a desired length of flat cable determined by the measuring unit 33 and located in a vertical plane is drawn from conventional supply reels (not shown) by the cable feeding unit 34; slit to form a series of eyes or buttonholes 51 at desired intervals along its length during its passage through the eye forming unit 32; slit at the leading end, as desired, to provide a cable divided at one end as shown in FIG. 4*b* or the two separate cables of FIG. 4*c* by the end slitting unit 35. The leading end of the cable is then clamped by the cable rotating unit 37, rotated through 180°, which rotation also locates the slit ends in the separating unit 38 with subsequent cable feed to form a small loop and separation of the slit ends. The separate ends of the cable are then gripped by left jaws of the transfer unit 39, the cable is fed by feed unit 34 to form a loop of desired length, the trailing end gripped by right jaws of the transfer unit, and both ends rotated through 90° to bring individual conductors into precise alignment with contacts of connectors 12 on the feed path. The insertion unit then inserts the cable conductors partly into the connectors housings 13 or contacts and the connectors carrying the loop cable are indexed along the feed path to connector housing closure application station 15 where closures are stuffed into the housings to drive the conductors into the slots of insulation displacement contacts therein so that the slot edges establish permanent electrical connection to the conductors. The connectors are of the well known type described in French Patent Publication No. 2460553, French Patent Publication No. 2473225, and the closure application station 15 is similar to that described in U.S. Pat. No. 2,521,358.

The resulting harnesses of FIGS. 4 are then indexed along the feed path through the respective stations which are of conventional design.

It will be appreciated that full termination of the wires could readily be achieved by a similar, modified insertion unit in a modified connector without the use of the preferred closure members.

As shown in FIGS. 5 to 10*c*, and as best seen in FIGS. 5, 8 and 9, the eye forming unit 32 comprises a box-like frame including horizontal and vertical members 61, 61'; 62, 62' housing a slitting mechanism 63. The slitting mechanism 63 is mounted on a carriage 64 located on vertical guide rods 65, 65' extending between frame members 61, 61' for vertical adjustment by means ofo a stepping motor 67 connected to the carriage 64 by a vertically extending screw 68 engaging a carriage nut 69. Various sensors, e.g. 70, 70', are provided in conventional fashion to detect the vertical location of the carriage.

Briefly stated, as best seen in FIGS. 5, 6 and 7, the slitting mechanism 63 comprises a cable nip 71 comprising first and second cable engaging rollers 74, 75 respectively, a clutch 76 associated with the second roller 75 for effecting rotation of a cable slitting knife 77 into slitting engagement with the cable, and an escapement 78 for controlling rotation of the knife 77.

The cable nip 71 includes an outer idling roller 74 suspended for rotation from an arm 81 connected by a transverse arm 82 to a piston and cylinder 83 operable to urge the nip roller 74 horizontally towards the roller 75 thereby to trap and grip a cable 30 between them to effect rotation of the rollers. A conventional guard 84 (FIG. 5) is also carried by the arm 82.

As best seen in FIGS. 6 and 7, the clutch mechanism 76 comprises upper and lower roller parts 86, 87 respectively, freely mounted on a common rotary shaft 88 adjacent opposite faces of a disc-like body portion 89 of the slitting knife 77 which has two cable-engaging teeth extending from its periphery 91, 91', at diametrically opposite locations. A jack cylinder 92 is fixed to a lower end of the shaft 88 and operatively receives a piston 93 mounted on the shaft 88 below roller half 87. Operation of the piston and cylinder so constituted will cause the piston to urge the roller half into abutment with the knife body 89 urging it into frictional engagement into both roller halves 86 and 87 to produce rotation of the knife body at intervals permitted by the escapement when the rollers 74, 75 are rotated by the cable travel.

The escapement 78 comprises a fork 101 pivotally mounted at one end on a sleeve 102 set in a cylinder block 103 to extend above the roller 75 and housing, the ends of its arms being formed with a stop surface 105 and a hook catch 106, respectively located at respective opposite ends of an arcuate track 107. A pin 108 upstands from the fork 101 at a location between its ends and is received in slots 109, 110 in walls of a double-acting piston and cylinder 112.

A sleeve 114 is mounted on the shaft 88 above the roller half 86 on bearings 115 and 116 permitting rotation relative to either the shaft 88 or the roller half 86 and is fixed at a lower end by a pin 117 to the body 89 of the knife and carries a pin 118 upstanding from its upper surface for engagement with the escapement fork 101. Consequently, the knife 77 will be prevented from rotation when rotation of the pin 118 is arrested by the escapement fork 101.

In operation of the escapement, with the clutch 76 and nip 71 engaged with the knife 77 and cable 30, respectively, and commencing at the position shown in FIGS. 7 and 10*a* where the nip roller halves 86 and 87 and roller 84 are rotated by the cable 30, the pin 108 abuts the end 107 of the fork 101 with the teeth 91, 91' out of engagement with the cable, preventing rotation. Operation of an electrovalve 121 (FIG. 5) causes air to be fed to the right side of cylinder driving the piston and the fork 101 to the left in the sense of FIG. 7 and in the direction of the arrow in FIG. 10*a* to the position of FIG. 10*b*. This releases the pin 118 to travel along the track 107 permitting rotation of the knife through 180° by frictional engagement of the knife body with the roller halves with tooth 31 slitting the cable 30 (as shown in FIG. 10*b*) until the pin 118 is trapped by the catch 106 as shown in FIG. 10*c*, thereby cutting a fastening eye 51 in the cable 30. Subsequent operation of the electrovalve to charge the left side of the cylinder 112, driving the piston and fork to the right (in FIG. 7), upwardly (in FIG. 10*c*) will release the pin 118 from the catch 106, permitting a further 180° rotation of the knife 77 and another eye to be cut by the tooth 91 in the cable. Thus, eyes 51 may be formed in the cable 30 at any desired intervals along its length.

Release of the clutch enables free rotation of the roller halves 86 and 87 and the idler roller of the nip 71 by the passage of the cable without rotation of the knife 77.

As shown in FIGS. 11 and 12, the measuring unit 33 comprises a box-like housing including main upper and lower transverse frame members 131 and 132, respectively, joined by spaced vertical members 133, 134 and a bridging vertical member 135.

One roller 136 of a nip 139 is mounted on a vertical axle 137 rotatably mounted between frame members 131 and 132 and operatively connected at an upper end to a counter 138 of conventional design. The other roller 141 of the nip 139 is fixed to a vertical axle 142 rotatably mounted in a frame block 143 which is connected to one end of a pair of connecting arms 144, 144' passing to each side of the roller 136 and a cross member joined to a piston and cylinder assembly 145, operation of which moves the roller 141 from the position shown in broken lines towards the roller 136 to grip the cable 30 therebetween, the positions being detected by sensors 146, 146'. Passage of the cable through the nip rotates the roller 136 operating the counter to measure the length of cable feed.

As shown in FIGS. 13, 14 and 15, the cable feeding unit 34 is of essentially similar construction to the measuring unit 33 comprising a pair of nips 151, 151'; drive rollers 152, 152' of which are mounted for rotation about a vertical axis in a fixed frame part generally indicated at 153 and connected through a conventional gear train 154 to a stepping motor 155. Idler rollers 156, 156' are joined by arms 157, 157' to a piston and cylinder assembly 158 operative to draw the idler rollers towards the drive rollers to grip the cable therebetween so that operation of the stepping motor will advance the cable. Conventional sensors 159, 159' indicate the position of the idler rollers.

As shown in FIGS. 16 to 20, the cable end slitting unit 35 comprises a blade 162 mounted by a conventional pin and slot adjuster 163 on a holder 164 adjacent a standoff wheel 165 for advance and withdrawal (the position indicated in broken lines in FIG. 16) detected by sensors 166, 166' by a piston and cylinder assembly 167 seated in one side of a carriage block 168. The carriage block 168 is mounted on vertical guide 171 for vertical adjustment by a stepping motor 173 driving a screw 174 rotatably linked by a shaft extending through a hollow vertical block 175 (supporting the frame block 168) at a lower end and cross-frame parts 178 at an upper end in engagement with a nut 179 seated in the block 168. The vertical position of the carriage block is indicated by sensors 181.

Movement of the cable end slitting unit horizontally along the cable 30 is effected by the mechanism shown most clearly in FIG. 20. Vertical block 175 is secured to a carriage 184 mounted for movement along upper and lower guide rods 185, 185' extending horizontally across a rectangular support frame 186 effected by a stepping motor 187 driving a horizontal screw 188. A known arrangement of sensors 191, 192, 193 is provided to indicate the rightmost, leftmost, and zero or null positions of the carriage, sensors 192 and 193 being operated by an arm 195 fixed to a rod 196 connected to the carriage for lost motion in the right direction and for movement towards the frame against a return spring 197 when the left travel of the frame passes a predetermined (null) position.

A cable guide 201 supports the cable 30 during its travel through the end slitting unit and comprises an unpright frame plate 202 fixed to the table 31 having hooks 203 extending from a lower end and a spring-loaded catch 204 from the upper end to releasably mount a cable receiving sleeve 205 which comprises a front plate 206 formed with a horizontal, blade-receiving slot 207 extending from a front end rearwardly of the direction of cable travel and a backing plate 208 formed with a blade-receiving groove 209 aligned with the slot 207 (as shown in FIG. 17).

As shown in FIGS. 21A, 21B, 22 and 23, the cutting unit 36 comprises a generally rectangular frame 220 defining a cable-receiving window 222 to one upright frame member 223 of which is fixed a shear plate 224. Guide strips 226, 226' are fixed along horizontal frame members defining channels receiving a cutting knife 227 assembled to a cable hold-down 228. A cable engaging head 231 of the hold-down is located on a spring 232 for lost motion relative to the blade on engaging the cable. The knife and hold-down assembly 227, 228 is operated by a piston and cylinder assembly 234 so that, when advanced from the position shown in FIGS. 21A and 22 to that of FIG. 23, the head 231 of the hold-down restrains the cable while the knife 227 severs the cable in cooperation with the shear plate 224. A clamping assembly generally indicated at 236 is provided with an adjustment slot 238 and locking bolt 229 to enable adjustment of the cutting unit to compensate for blade wear. Sensors (not indicated) are provided to detect the position of the knife, in conventional manner.

As shown particularly in FIGS. 25 and 26, the cable rotating unit 37 and associated separating unit 38 are supported by upper and lower horizontally extending fixed frame parts 250, 251 respectively. The cable rotating unit 37 comprises a cylindrical pulley block 253 mounted for reciprocal rotation through 180° about a vertical axis on a fixed frame block 254 on frame part 251 by an upper portion 225 of the drum being connected to a stepping motor 256 mounted on frame part 250. The pulley block 253 is formed with an axial bore 258 incorporating a piston and cylinder assembly 259 and a transverse bore 260 accommodating a cam mechanism 257 operatively connecting the piston and cylinder assembly 259 to a cable clamp 263. More particularly, the piston 265 has a stem 266 slidably mounted in an air supply block 267 of the block 254 while the other end carries a rod 268 fixed to a cam 269 slidably located in a cam track 271 in a cam follower 272 to which the cable clamp 263 is bolted. Vertical reciprocation of the piston thus causes the cam 269 to reciprocate the cam follower 272 and clamp 263 horizontally towards and away from the pulley block 253 to bring a friction pad 274 carried by the clamp 263 into and out of clamping engagement with a cable 30 located between the pulley block 253 and the friction pad 274. When the cable is clamped adjacent a leading end, the stepping motor can be operated to rotate the drum to the position shown in FIG. 24*b*, and in broken lines in FIG. 25, turning the leading end of the cable through 180° thereby and delivering the tip(s) of the cable to the jaws of the associated separating unit described below. The positions of the cable clamp 263 and the pulley block are detected by sensors 281–284 fixed to the frame part 250.

As shown more particularly in FIGS. 28*a*–28*c*, the cable separating unit 38 is housed in a box-like frame 301 mounted for vertical adjustment along a vertical guide rod 303 by means of a stepping motor 304 rotating a vertical screw 305 engaging a nut in the frame.

The operative parts of the cable separating unit include first and second pairs of cooperating jaws 311, 312, 311', 312', a first jaw 311, 311' of each pair being pivotally connected at one end 310, 310' to the second jaw 312, 312' of its pair for pivotal movement in a horizontal plane away from and towards the (fixed) second jaw 312, 312' between cable-receiving and cable-clamping positions (FIGS. 24*a* and 24*b* respectively). The second jaws 312, 312' are mounted within the frame on the vertical guide 303 for cable-separating movement of the jaw pairs vertically apart against the action of return springs 314, 314' seated between the second jaws 312, 312' and adjacent horizontal parts of frame 301.

Both the vertical movement of the jaw parts relatively apart to separate the cable and the pivotal movement of the first jaws 311, 311' of each pair relative to the cooperating second jaw 312, 312' are effected by a wedge member 320 located between the first jaws and operatively connected to a piston 321 and cylinder assembly. Opposed camming surfaces 322, 322' on the wedge member 320 engage cam following surfaces 323, 323' on the first jaws 311, 311' to effect movement apart of the jaw pairs white hook-form rear extensions 325, 325' fixed to each first jaw 311, 311' are engaged by the rear 326 of the wedge 320 when withdrawn by the piston and cylinder to pivot the first jaws 311, 311' apart into the cable-receiving condition. A crank 340 is fixed to the piston rod of cylinder 321 to effect operation of position sensors 341, 341' (FIG. 24*a*).

In operation, the first jaws 311, 311' are pivotally withdrawn from their cooperating fixed jaws 312, 312' by engagement of their hooked extensions 325, 325' with the rear surface 326 of the wedge 320 by withdrawal by the piston and cylinder assembly producing the cable-receiving condition shown in FIGS. 28*a* and 24*a*. When the leading end of a cable is delivered to the jaws by rotation of the pulley 253, the wedge 320 is advanced by the piston and cylinder 321 with engagement of the camming and cam following surfaces 322, 322' and 323, 323' initially to pivot the first jaws 311, 311' towards their cooperating jaws 312, 312' as a result of the compressive force of the return springs 314, 314' to the cable-gripping condition of FIGS. 28*b*, 24*b* and 27; further advance of the wedge 320 camming the jaw pair apart against the action of the return springs 314, 314' to separate the split cable ends as shown in FIGS. 26 and 28*c*.

As shown particularly in FIGS. 29, 30 and 31, the cable transfer unit 39 comprises a cable transfer head 351 including spaced upright and transverse frame members 354 and 355 respectively, supported on vertical guides 356 slidably mounted in a fixed base frame 357 for vertical movement of the head between an upper cable-transfer position, an intermediate cable-aligning position, and a lower connector-indexing position, by a connecting rod 358 extending between the frame member 355 and a piston and cylinder assembly 361. A hydraulic buffer 363 is fixed to the cross-member 355 for engagement with a roller 365 advanced from the insertion unit, as described below, to arrest downward movement in the intermediate position of the transfer head and with an adjustable stop 366 provided on a cross-member 367 of the fixed base frame 357 in the lowest connector-indexing position. Adjusters 368 are provided on the cross-member 367 to adjust the vertical height of the cylinder 361 and head.

As viewed in FIGS. 29 and 30, the transfer head 351 includes left and right pairs of cooperating jaws 371, 372 and 371', 372' respectively, the inner jaws 371, 371' of each pair being mounted both for pivotal movement on the bodies of their respective outer jaws 372, 372' between positions extending at 90° from the outer jaws when the latter are horizontal, through cable-receiving positions shown in broken lines, to the vertical cable-gripping position shown, such movement being effected by engagement of pinions 374, formed on the pivoted ends of the inner jaws and racks 375 operated by piston and cylinder assembly 378 incorporated in the bodies of the outer jaws. Each piston and cylinder assembly 378 includes a hollow piston 379 integrally formed with rack 375 and carrying an axially extending pin 380 which retains a compression spring 381 within the piston body, and a head 382 projecting axially out from the cylinder of the assembly for actuation of piston sensors 383, 384 mounted on top of the body of each outer jaw 372, 372'.

The outer jaws 372, 372' are pivotally mounted for rotation apart between vertical cable-receiving and cable-aligning positions of FIGS. 30 and 31 to horizontal cable-aligning positions indicated in FIG. 33 by each jaw 372, 372' being fixed to a spindle 391 of a first pinion 392 meshed with a second pinion 393 meshed in turn with a rack 394 reciprocated by a piston and cylinder assembly 395.

In summary, the outer jaws 372, 372' can be rotated through 90° between horizontal cable-aligning and vertical cable-receiving positions by operation of piston and cylinder assembly 395. The inner jaws can be rotated by the piston and cylinder assembly 378 through 90° relative to the outer jaws when the latter are in a horizontally extending position and subsequent movement of the outer jaws from the horizontal to the vertical orientation bringing the inner jaws into abutment compressing the spring 381.

The jaw pairs and associated pivoting mechanisms 400, 400' are mounted on blocks 400, 400' slidably mounted on guides 401, 401' extending horizontally between upright frame members 354 for translational movement together and apart between cable-aligning and cable-receiving positions by the operation of piston and cylinder assemblies 402, 402' connected to depending ears 403, 403' of the blocks 400, 400'.

As shown in FIGS. 32 and 33, the cable insertion unit comprises a pair of insertion rams 411, 411' mounted by wedge-type adjusters 413, 413' in a head 415, 415' which extends transversely from uprights 416, 416' secured to blocks by a common transverse support block 421 fixed to one face of a slide block 422. The slide block is formed at a rear end with a downwardly opening socket 424 receiving an enlarged head 425 on a piston rod 426 of a piston and cylinder assembly 451. A rear wall 427 of the socket 424 is formed with a downwardly opening vertical slot 428, narrower than the head 425, through which the piston rod 426 extends. Operation of the piston and cylinder assembly 451 will reciprocate the blocks 423 and 421, to both slide along a channel 420 formed in support block 423 between positions in which the insertion ram 411 is aligned with a connector 13 on the feed path 12, as shown in FIG. 33, and in which the insertion ram 411 is transversely withdrawn therefrom.

The transverse support block 423 is mounted for vertical movement to raise and to lower the insertion heads 411, 411' to insert cable conductors into the connectors by piston and cylinder assemblies 441, 441' housed in rectangular frames 442, 442'. Heads 444 of the piston rods are received in slots 445 in the block 423 for relative horizontal sliding movement therealong to accommodate advance of the insertion head and blocks 421, 422 into alignment with the connector. Sensors 481, 481' and 482 are carried by a bracket 484 fixed to a frame upright 485 to indicate the vertical and horizontal positions of the insertion heads 411, 411'.

The roller stop 365 is mounted in a clevis on an arm 471 connected to a piston and cylinder assembly 475 for advance on slide rails 476 to be engaged by the hydraulic buffer 363 to arrest the descent of the transfer head 351 to the cable-aligning position as shown in FIG. 33.

The positions of the roller stop 365 are detected by sensors 477 carried by a bracket 478 secured to the front of a base block 479 supported by a base frame 481.

One mode of operation of the apparatus to make a ribbon cable harness divided and terminated in two connectors 13 at a leading end and undivided and terminated in a single connector at a trailing end will now be described by way of example with reference to the timing diagram of FIG. 34 and the sequence sketches of FIGS. 35*a*–35*l*.

Figure 35A:
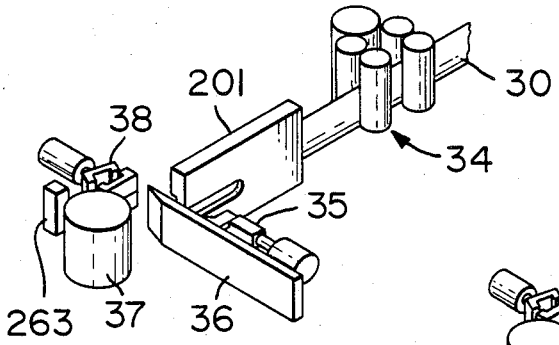

As shown in FIG. 35A, at the start of the cycle, the cable 30 has been advanced by the cable feeding unit 34 to the block of the cutting unit 36 which acts as a stop extending across the cable feed path, the cable rotating unit 37 is in its leftmost position with the clamp 263 open, and the cooperating jaws of the cable separating unit are open with the jaw pairs together.

Figure 35B:
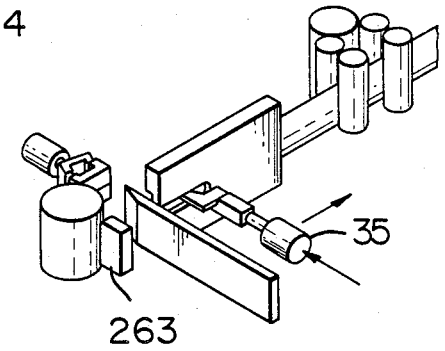

The cable rotating unit is then rotated back through 180° while the knife of the cable end slitting unit 35 is advanced to pierce the cable 30. The knife is then traversed along the cable to divide the ends as shown in FIG. 35B.

Figure 35C:
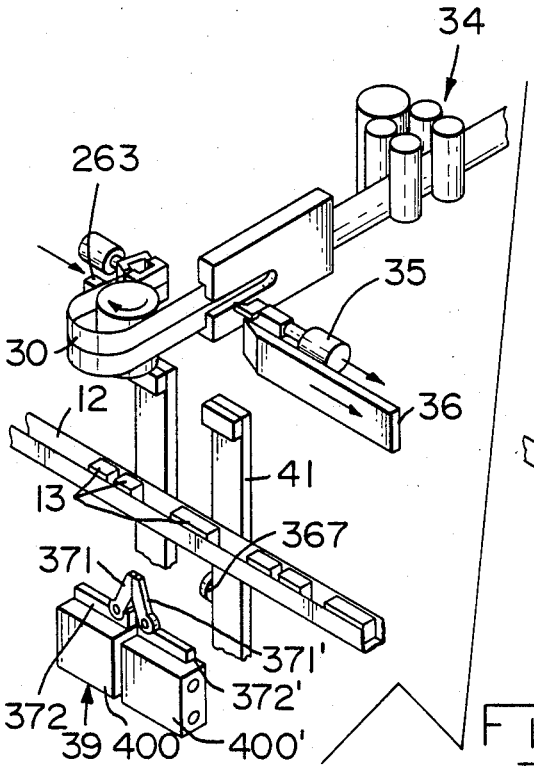
Figure 35D:
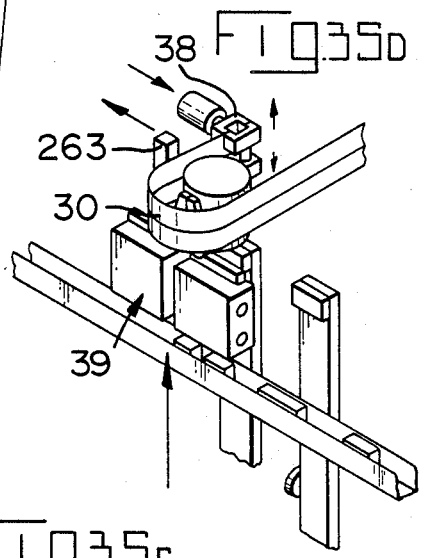

The slitting knife is then retracted, the slitting unit 35 traversed back to a position adjacent the cutting unit 36 and the knife of the cutting unit 35 withdrawn to permit feed of the cable by the cable feeding unit 34 to the cable rotating unit 37, where it is clamped. The cable rotating unit 37 is then rotated clockwise through 180° with feed of the cable by the cable feeding unit 34 to position a leading end of the cable between the open jaws of the cable separating unit as shown in FIG. 35C.

In this condition of the apparatus, the heads of the insertion unit 41 are displaced transversely of and raised from the feed path 12. The head of the cable transfer unit 39 is at its lowermost position with the inner jaws 371, 371' vertical, the outer jaws 372, 372' horizontal, and the jaw pairs carried by the blocks 400, 400' adjacent each other in the cable-aligning position.

The cable separating unit 36 then actuates the jaws 311, 312; 311', 312' of each pair to grip the cable end and separate the cable ends by movement apart of the jaw pairs 311', 312' and 311', 312' while the clamp 263 of the cable rotating unit 37 releases the cable. The head of the transfer unit 39 is then raised to bring the inner jaws 371, 371' into the cable loop. This is the condition shown in FIG. 35D.

Both outer jaws 372, 372' of the transfer unit are then pivoted through 90° to an upright position and the jaw blocks 400, 400' moved apart from a former position aligned with the connectors 13 to surround the cable 30 on each side of the loop. The left-hand inner jaw 371 is then closed against the cooperating outer jaw 372 to grip the cable between them on the left-hand side of the loop to provide the condition shown in FIG. 35E.

The cable feeding unit 34 is then operated to feed the cable to a desired length while the left jaw block 400 returns towards the right block 400' and alignment with the fresh connectors. The right inner jaw 371' then closes against the cooperating outer jaw 372' to grip the trailing end of the cable 30 and the stop roller 365 is advanced into alignment with the buffer 367 on the head of the transfer unit. The cutter unit 36 then advances the knife to cut the cable 30 to length, the jaw pairs 311, 312, 311', 312' of the separating unit 38 are returned together, and the coopeating jaws of each pair separated to release the leading end of the cable to the transfer unit to provide the condition shown in FIG. 35F.

Figures 35E, 35F, 35G:
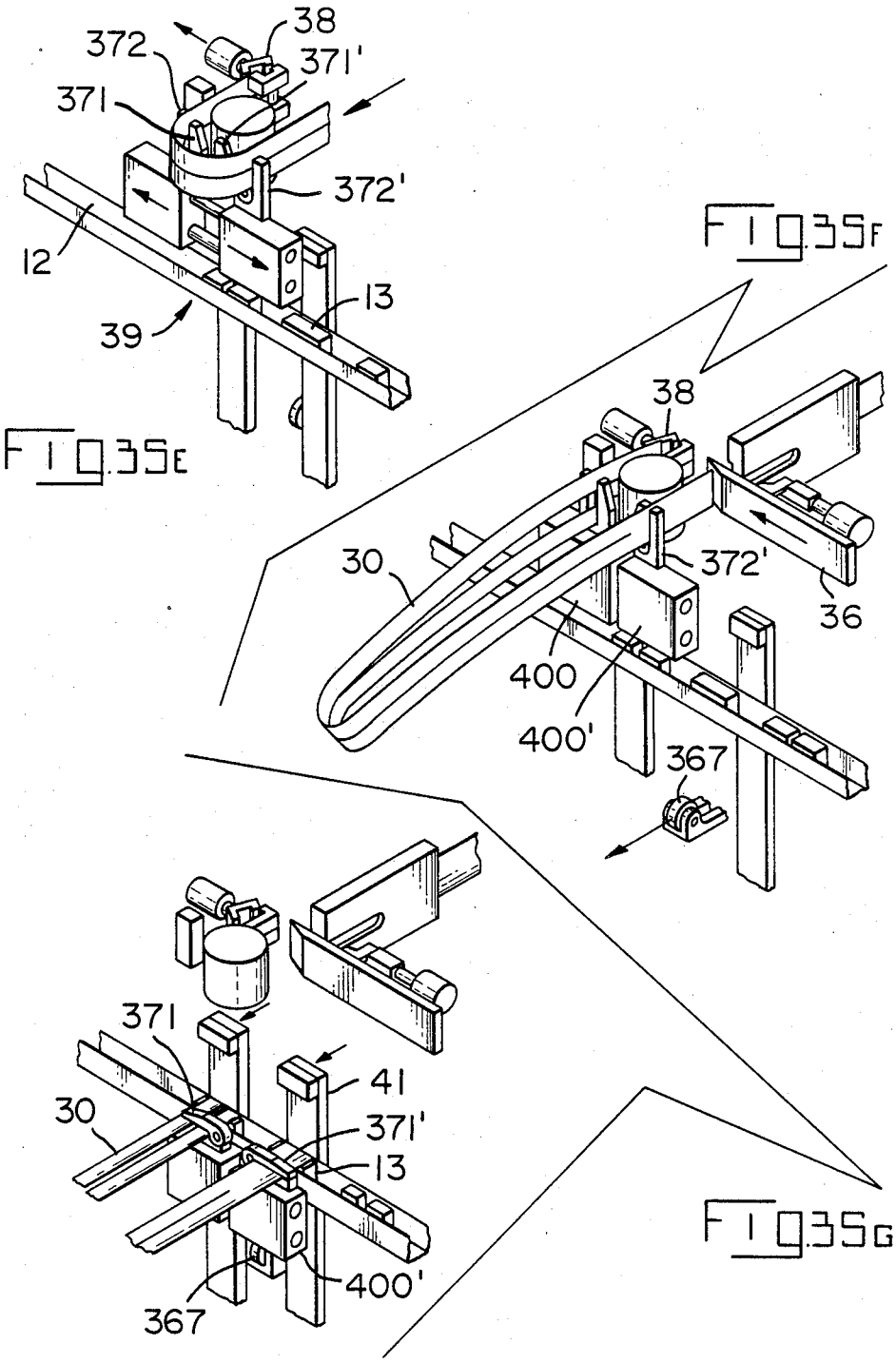

The head of the transfer unit 39 is then lowered until the buffer 363 engages the roller stop 365 and the jaw pairs 311, 312, 311', 312' are rotated away from each other through 90° to bring the gripped cable ends into the horizontal plane with individual conductors aligned with respective contacts of connectors 13 on the feed path 12. The insertion head of insertion unit 41 is then moved across the feed path into vertical alignment with the connectors as shown in FIG. 35G.

Figure 35H:
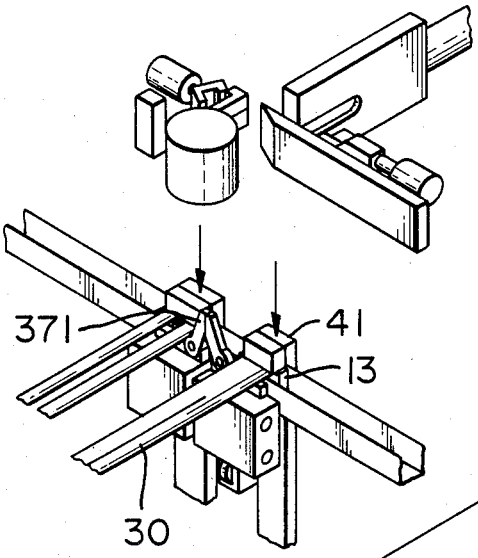
Figure 35I:
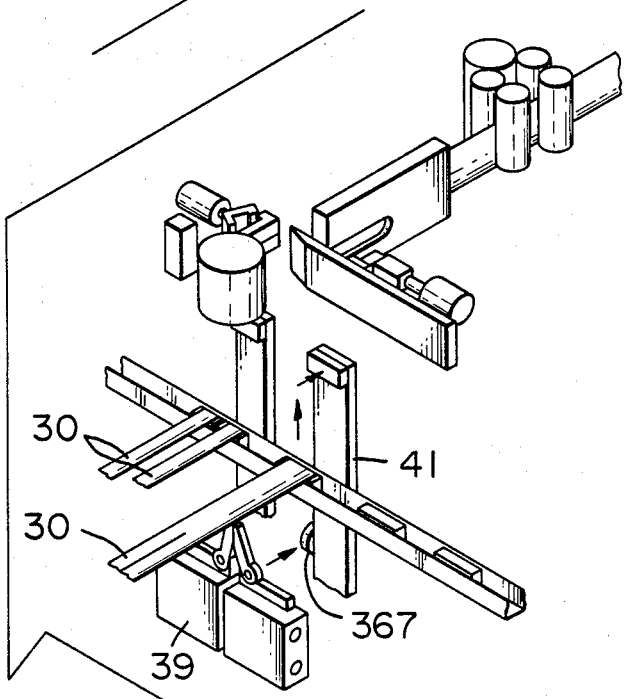

The inserter 41 is then operated to stuff the individual conductors of the cable 30 into the respective contact slots of the connectors 13 with subsequent pivotal movement of the inner transfer jaws 371, 371' to an upright position to release the cable 30 as shown in FIG. 35H.

Finally, the roller stop 365 is withdrawn and the head of the transfer unit 39 lowered to provide clearance for the preformed harness to be indexed along the feed path 12 to the connector closure applying unit 15. The insertion heads are raised and withdrawn away from the feed path to provide the condition shown in FIG. 35G.

We claim:

1. A method of making electrical harnesses in which a conductor is terminated at opposite ends by respective connectors (13) comprising the steps of indexing pairs of connectors (13) along a feed path (12) past a terminating station (41) with rows of contacts in a conductor-receiving face of the connectors (13) extending along the feed path (12), feeding the conductor longitudinally to the terminating station (41) in a direction extending transversely of the connector feed path (12), turning the leading end of the conductor to form a loop of desired length extending transversely of the feed path (12), and inserting the leading and trailing ends of the loop in respective connectors (13) on the feed path (12), characterised by the step of feeding flat cable (30) towards the feed path (12) with its plane and the axis of said loop extending perpendicularly to the contact rows, and rotating the conductor-receiving face of the connectors (13) and the leading and trailing ends of the loop through 90° about their longitudinal axis to bring the plane of the cable ends parallel to the contact rows with individual conductors aligned with respective contacts.

2. A method according to claim 1, characterised in that the cable loop is fed to desired length to extend across the feed path (12).

3. A method according to claim 1, characterised in that the leading and trailing ends of the cable (30) are rotated in opposite angular directions to present the same side of the cable (30) to the respective connectors (13) at each end of the cable (30).

4. A method according to claim 1, characterised in that a slit is formed in one end of the cable (30) to divide the one end into branches.

5. Apparatus for making a harness in which a conductor is terminated at opposite ends by respective electrical connectors (13) comprises connector transfer means to index a series of connector pairs (13) along a feed path (12) past a terminating station with contact rows of the connectors (13) extending along the feed path; means to feed a conductor (30) to the terminating station (41) along a path extending transversely of the feed path (12); means to form loops of desired length in a leading end of the conductor extending across the feed path (12); and means (41) to insert the leading and trailing ends of the conductor (30) loop in respective connectors (13) of the pair on the feed path (12) is characterised in that for making harnesses of flat cable, the cable feed means feeds the flat cable to the feed path (12) with its plane extending perpendicularly of the contact rows and to form said cable loop with the axis of said loop perpendicular to the contact rows so that respective ends of said cable loop extend perpendicularly of the feed path (12), and transfer means (39) to transfer the cable ends from the loop-forming means and to twist the cable ends through 90° to extend in planes parallel to the contact rows with the individual conductors extending perpendicularly of the connector rows aligned with the respective contacts.

6. Apparatus according to claim 5, characterised in that the transfer means (39) twists the cable ends in opposite angular directions.

7. Apparatus according to claim 6, characterised in that means (35) are provided to slit the one end of the cable (30) longitudinally to divide it into a plurality of branches.

8. Apparatus according to claim 7, characterised in that cable end separating means (38) are provided to grip the divided ends of the cable (30) and to move them apart in the plane of the cable (30).

9. Apparatus according to claim 8, characterised in that the cable separating means comprises first and second pairs of cooperating jaws (311,312; 311',312'), and that means are provided to link the first jaws (311,311') of each pair to the second cooperating jaws (312,312') for relative movement in a first plane between a cable-receiving position and a cable-gripping position, and the second jaws (312,312') being mounted on a guide (303) for relative movement apart of the jaw pairs along axis perpendicular to the first plane against biasing means (314), a cam member (320) being trapped between the first jaws (311,311'), and means (321) being provided to move the cam member (320) in the first plane in one direction relatively away from the second jaws (312,312') drawing the first jaws (311,311') to the open cable-receiving condition and in the opposite direction initially to close the jaws to grip the cable (30) and finally to drive the closed jaws apart to separate the divided cable ends.

10. Apparatus according to claim 8, characterised in that the loop forming means (37) comprise a cable pulley (253) and an associated cable clamping jaw (263) operable to clamp the cable (30) against the pulley (253) located adjacent the cable end separating means (38), means being provided to pivot the pulley (253) about an axis extending perpendicularly to the cable insertion face of the connectors (13) between a cable end-receiving and clamping position and a cable loop-forming position turning the clamped end of the cable to form a loop precursor and delivering the trimmed end of the cable to the cable end separating means (38).

11. Apparatus according to claim 10, characterised in that the clamping jaw (263) is connected to a cam follower (271) mounted in a cavity (258) in the pulley (253) for reciprocal transverse sliding movement to move the jaw (263) between cable-gripping and cable-receiving positions, the cam follower (271) being operated by a cam member (269) in the cavity operatively connected to a piston and cylinder assembly (259) having a working stroke axially along the cavity (258).

12. Apparatus according to claim 11, characterised in that one end of the cam member (271) is slidably mounted in a slot (255) in the cam follower (272) which slot (255) extends obliquely of the pulley axis.

13. Apparatus according to claim 5, characterised in that the cable transfer means (39) comprises a transfer head (351) including first and second pairs of cooperating cable gripping jaws (371, 372 and 371', 372' respectively) located side-by-side with the first, inner jaws (371, 371') of the pairs of jaws (371, 372; 371', 372') adjacent each other and pivotally mounted on their cooperating second jaws (372, 372') for movement about a piotal axis extending perpendicular to the contact rows in the same plane through substantially 90° relative thereto between cable end-receiving positions and cable end-gripping positions, the second, outer jaws (372, 372') of each pair of jaws (371, 372; 371', 372') are pivotally mounted for rotation in the same plane through 90° together with their first jaws (371, 371') between cable end-receiving and gripping positions and cable end-delivery positions aligning the cable ends with the contact rows.

14. Apparatus according to claim 13, characterised in that means (361) are provided to reciprocate the transfer head (351) vertically between cable-receiving and cable-delivery positions spaced apart above and adjacent the connectors (13) on the feed path (12), respectively.

15. Apparatus according to claim 5, characterised in that means (32) are provided to form eyes (51) at intervals along the cable length, the eye forming means (32) comprising a cable-driven knife (77) having a body (89) rotatable by feed of the cable (30) to bring a radially projecting cable slitting tooth (91, 91') into eye-forming engagement with the cable (30); and an escapement (78) operable to engage the knife (77) both to regulate and to limit rotation of the knife (77) by the cable (30).

16. Apparatus according to claim 15, characterised in that the knife body (89) is mounted between roller halves (86, 87) on a common rotational axis, means being provided to urge the roller halves (86, 87) against the cable (30) to effect rotation thereof and clutch means (76) to urge the roller halves (86, 87) and knife (77) relatively into engagement in an axial direction thereby to effect rotation of the knife (77) when permitted by the escapement (78).

17. Apparatus according to claim 16, characterised in that the escapement (78) comprises a fork (101) the divided ends of which form an abutment (105) and hook catch (106) respectively on opposite ends of a guide track (107) and a pin (118) fixed to the knife body (89) to extend in the axial direction for rotation therewith, the fork (101) being mounted for limited pivotal movement in its plane, means being provided to pivot the fork (101) in its plane to first and second extreme pivotal positions in which the abutment end (105) and the hooked end (106) of the fork (101) are radially spaced outwardly from the path of rotation of the pin (118) so that the abutment (105) and hook (106) arrest and release the rotation of the pin (118) alternately, pivotal movement of the fork (101) being regulated by the pin and engaging the track (12) during its rotational travel between the abutment (105) and the hook (106) which ensures capture by the hook (106).

* * * * *

UNITED STATES PATENT AND TRADEMARK OFFICE

CERTIFICATE OF CORRECTION

PATENT NO. : 4,793,038

DATED : December 27, 1988

INVENTOR(S) : Jean B. Guerout, et al

It is certified that error appears in the above-identified patent and that said Letters Patent is hereby corrected as shown below:

Column 13, line 44, claim 13, change "piotal" to --pivotal--.

Signed and Sealed this

Second Day of May, 1989

*Attest:*

*Attesting Officer*

DONALD J. QUIGG

*Commissioner of Patents and Trademarks*